US011339654B2

(12) United States Patent
Sollami

(10) Patent No.: US 11,339,654 B2
(45) **Date of Patent: *May 24, 2022**

(54) INSERT WITH HEAT TRANSFER BORE

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 144 days.

This patent is subject to a terminal disclaimer.

(21) Appl. No.: 15/970,070

(22) Filed: May 3, 2018

(65) Prior Publication Data

US 2019/0234213 A1 Aug. 1, 2019

Related U.S. Application Data

(63) Continuation-in-part of application No. 15/950,676, filed on Apr. 11, 2018, and a continuation-in-part of (Continued)

(51) Int. Cl.
*E21C 35/183* (2006.01)
*E01C 23/088* (2006.01)
(Continued)

(52) U.S. Cl.
CPC ..... *E21C 35/1837* (2020.05); *E21C 35/183* (2013.01); *E21C 35/1833* (2020.05);
(Continued)

(58) Field of Classification Search
CPC ..... E21C 2035/1803; E21C 2035/1806; E21C 2035/1809; E21C 2035/1816; E21C 35/18; E21C 35/183; E21C 2035/1813; E21C 35/1831; E21C 35/1833; E21C 35/1835; E21C 35/1837; E21C 35/197; E21B 10/46–10/55; E21B 10/56–10/5735; E01C 23/088; F27B 5/04; B22F 7/062
See application file for complete search history.

(56) References Cited

U.S. PATENT DOCUMENTS 2,382,947 A 7/1944 Brozek
2,810,567 A 10/1957 Kirkham
(Continued)

FOREIGN PATENT DOCUMENTS

DE 102004049710 4/2006
DE 102011079115 1/2013
(Continued)

*Primary Examiner* — Abby J Flynn
*Assistant Examiner* — Michael A Goodwin
(74) *Attorney, Agent, or Firm* — Mercedes V. O'Connor; Rockman Videbeck & O'Connor

(57) ABSTRACT

A bit tip insert on a bit/holder, tool, and/or pick for road milling operations that includes a body including a tip and a base subjacent the tip The bit tip insert also includes at least one heat transfer bore extending from a distal end and/or bottom of the body to a bore termination disposed within the base and/or the tip of the bit tip insert. The at least one bore of the bit tip insert is adapted to allow inward contraction when the overlay transfers heat into the base during operation.

28 Claims, 17 Drawing Sheets

Related U.S. Application Data application No. 15/923,051, filed on Mar. 16, 2018, and a continuation-in-part of application No. 14/676,364, filed on Apr. 1, 2015, now Pat. No. 9,976,418.

(60) Provisional application No. 61/974,064, filed on Apr. 2, 2014.

(51) Int. Cl.

| | |
|---|---|
| *E21B 10/46* | (2006.01) |
| *E21B 10/567* | (2006.01) |
| *E21C 35/197* | (2006.01) |
| *F27B 5/04* | (2006.01) |
| *B22F 7/06* | (2006.01) |
| *B22F 3/15* | (2006.01) |
| *B22F 5/00* | (2006.01) |

(52) U.S. Cl.

CPC ..... *E21C 35/1835* (2020.05); *B22F 3/15* (2013.01); *B22F 7/062* (2013.01); *B22F 2005/001* (2013.01); *B22F 2201/11* (2013.01); *B22F 2201/20* (2013.01); *B22F 2998/10* (2013.01); *B22F 2999/00* (2013.01); *E01C 23/088* (2013.01); *E21B 10/46* (2013.01); *E21B 10/567* (2013.01); *E21C 35/1831* (2020.05); *E21C 35/197* (2013.01); *F27B 5/04* (2013.01)

(56) References Cited

U.S. PATENT DOCUMENTS 3,342,531 A 9/1967 Krekeler
3,342,532 A 9/1967 Krekeler
3,397,012 A 8/1968 Krekeler
3,476,438 A 11/1969 Bower, Jr.
3,519,309 A 7/1970 Engle
3,833,264 A 9/1974 Elders
3,833,265 A 9/1974 Elders
3,865,437 A 2/1975 Crosby
4,084,856 A 4/1978 Emmerich
4,247,150 A 1/1981 Wrulich et al.
RE30,807 E 12/1981 Elders
4,310,939 A 1/1982 Iijima
4,453,775 A 6/1984 Clemmow
4,478,298 A 10/1984 Hake
4,489,986 A 12/1984 Dziak
4,525,178 A 6/1985 Hall
4,561,698 A 12/1985 Beebe
4,570,726 A 2/1986 Hall
4,604,106 A 8/1986 Hall
4,632,463 A 12/1986 Sterwerf, Jr.
4,694,918 A 9/1987 Hall
4,702,525 A 10/1987 Sollami
4,763,956 A 8/1988 Emmerich
4,811,801 A 3/1989 Salesky
4,818,027 A 4/1989 Simon
4,821,819 A 4/1989 Whysong
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,281,260 A * 1/1994 Kumar ..... E21B 10/52 175/426
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,484,191 A 1/1996 Sollami
5,492,188 A 2/1996 Smith et al.
5,541,006 A * 7/1996 Conley ..... E21B 10/5673 428/552
5,551,760 A 9/1996 Sollami
5,607,206 A 3/1997 Siddle
5,628,549 A 5/1997 Ritchey
5,720,528 A 2/1998 Ritchey
5,725,283 A 3/1998 O'Neill
5,806,934 A * 9/1998 Massa ..... E21B 10/006 299/111
5,823,632 A 10/1998 Burkett
5,924,501 A 7/1999 Tibbitts
5,931,542 A 8/1999 Britzke
5,934,854 A 8/1999 Krautkremer et al.
5,992,405 A 11/1999 Sollami
D420,013 S 2/2000 Warren
6,019,434 A 2/2000 Emmerich
6,102,486 A 8/2000 Briese
6,176,552 B1 1/2001 Topka, Jr.
6,196,340 B1 3/2001 Jensen et al.
6,199,451 B1 3/2001 Sollami
6,250,535 B1 6/2001 Sollami
6,331,035 B1 12/2001 Montgomery, Jr.
6,341,823 B1 1/2002 Sollami
6,357,832 B1 3/2002 Sollami
6,371,567 B1 4/2002 Sollami
6,382,733 B1 5/2002 Parrott
6,428,110 B1 8/2002 Ritchey et al.
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall

(56) References Cited

U.S. PATENT DOCUMENTS 7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,660 B2 8/2011 Monyak et al.
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
8,740,314 B2 6/2014 O'Neill
9,004,610 B2 4/2015 Erdmann et al.
9,028,008 B1 5/2015 Bookhamer
9,039,099 B2 5/2015 Sollami
9,316,061 B2 4/2016 Hall
9,518,464 B2 12/2016 Sollami
9,879,531 B2 1/2018 Sollami
9,909,416 B1 3/2018 Sollami
9,976,418 B2 5/2018 Sollami
9,988,903 B2 6/2018 Sollami
10,072,501 B2 9/2018 Sollami
10,105,870 B1 10/2018 Sollami
10,107,097 B1 10/2018 Sollami
10,107,098 B2 10/2018 Sollami
10,180,065 B1 1/2019 Sollami
10,260,342 B1 4/2019 Sollami
10,323,515 B1 6/2019 Sollami
10,337,324 B2 7/2019 Sollami
10,370,966 B1 8/2019 Sollami
10,385,689 B1 8/2019 Sollami
10,415,386 B1 9/2019 Sollami
10,502,056 B2 12/2019 Sollami
2002/0063467 A1 5/2002 Taitt
2002/0074850 A1 6/2002 Montgomery, Jr.
2002/0074851 A1 6/2002 Montgomery, Jr.
2002/0109395 A1 8/2002 Sollami
2002/0167216 A1 11/2002 Sollami
2002/0192025 A1 12/2002 Johnson
2003/0015907 A1 1/2003 Sollami
2003/0047985 A1 3/2003 Stiffler
2003/0052530 A1 3/2003 Sollami
2003/0122414 A1 7/2003 Sollami
2003/0209366 A1 11/2003 McAlvain
2004/0004389 A1 1/2004 Latham
2004/0174065 A1 9/2004 Sollami
2005/0212345 A1 9/2005 Sleep et al.
2006/0071538 A1 4/2006 Sollami
2006/0186724 A1 8/2006 Stehney
2006/0261663 A1 11/2006 Sollami
2007/0013224 A1 1/2007 Stehney
2007/0040442 A1 2/2007 Weaver
2007/0052279 A1 3/2007 Sollami
2008/0035386 A1 2/2008 Hall et al.
2008/0036276 A1 2/2008 Hall et al.
2008/0036283 A1 2/2008 Hall et al.
2008/0100124 A1 5/2008 Hall et al.
2008/0145686 A1 6/2008 Mirchandani
2008/0164747 A1 7/2008 Weaver et al.
2008/0284234 A1 11/2008 Hall et al.
2009/0146491 A1 6/2009 Fader et al.
2009/0160238 A1 6/2009 Hall et al.
2009/0256413 A1* 10/2009 Majagi ..... B28D 1/188
299/100
2009/0261646 A1 10/2009 Ritchie et al.
2010/0045094 A1 2/2010 Sollami
2010/0244545 A1 9/2010 Hall
2010/0253130 A1 10/2010 Sollami
2010/0320003 A1 12/2010 Sollami
2010/0320005 A1* 12/2010 Burhan ..... B22F 7/06
175/426
2010/0320829 A1 12/2010 Sollami
2011/0006588 A1 1/2011 Monyak et al.
2011/0089747 A1 4/2011 Helsel
2011/0175430 A1 7/2011 Heiderich et al.
2011/0204703 A1 8/2011 Sollami
2011/0254350 A1 10/2011 Hall
2012/0001475 A1 1/2012 Dubay et al.
2012/0027514 A1 2/2012 Hall
2012/0056465 A1 3/2012 Gerer et al.
2012/0068527 A1 3/2012 Erdmann
2012/0104830 A1 5/2012 Monyak et al.
2012/0181845 A1 7/2012 Sollami
2012/0242136 A1 9/2012 Ojanen
2012/0248663 A1 10/2012 Hall
2012/0261977 A1 10/2012 Hall
2012/0280559 A1 11/2012 Watson
2012/0286559 A1 11/2012 Sollami
2012/0319454 A1 12/2012 Swope
2013/0169023 A1 7/2013 Monyak
2013/0181501 A1 7/2013 Hall et al.
2013/0199693 A1 8/2013 Tank et al.
2013/0307316 A1 11/2013 Roetsch et al.
2014/0035346 A1 2/2014 Fundakowski et al.
2014/0110991 A1 4/2014 Sollami
2014/0232172 A1 8/2014 Roth et al.
2014/0262541 A1 9/2014 Parsana et al.
2014/0326516 A1 11/2014 Haugvaldstad
2015/0028656 A1 1/2015 Sollami
2015/0035343 A1 2/2015 Ojanen
2015/0137579 A1 5/2015 Lachmann et al.
2015/0198040 A1 7/2015 Voitic et al.
2015/0240634 A1 8/2015 Sollami
2015/0285074 A1 10/2015 Sollami
2015/0292325 A1 10/2015 Sollami
2015/0300166 A1 10/2015 Ries et al.
2015/0308488 A1 10/2015 Kahl
2015/0315910 A1 11/2015 Sollami
2015/0354285 A1 12/2015 Hall
2016/0102550 A1 4/2016 Paros et al.
2016/0194956 A1 7/2016 Sollami
2016/0229084 A1 8/2016 Lehnert
2016/0230470 A1* 8/2016 Keshavan ..... E21B 10/56
2016/0237818 A1 8/2016 Weber et al.

(56) References Cited

U.S. PATENT DOCUMENTS

| | | | |
|---|---|---|---|
| 2017/0089198 | A1 | 3/2017 | Sollami |
| 2017/0101867 | A1 | 4/2017 | Hall et al. |

FOREIGN PATENT DOCUMENTS

| | | | |
|---|---|---|---|
| DE | 202012100353 | | 6/2013 |
| DE | 102015121953 | | 7/2016 |
| DE | 102016118658 | | 3/2017 |
| EP | 3214261 | | 9/2017 |
| GB | 1114156 | | 5/1968 |
| GB | 1218308 | | 1/1971 |
| GB | 2483157 | | 2/2012 |
| GB | 2534370 | | 7/2016 |
| WO | 2008105915 | A2 | 9/2008 |
| WO | 2008105915 | A3 | 9/2008 |
| WO | 2009006612 | | 1/2009 |

* cited by examiner

INSERT WITH HEAT TRANSFER BORE

CROSS-REFERENCE TO RELATED APPLICATION(S)

This application claims priority to and is a continuation-in-part of U.S. Provisional Application No. 61/974,064, filed Apr. 2, 2014, claims priority to and is a continuation-in-part of U.S. Non-provisional application Ser. No. 14/676,364, filed Apr. 1, 2015, claims priority to and is a continuation-in-part of U.S. Non-provisional application Ser. No. 15/923,051, filed Mar. 16, 2018, and claims priority to and is a continuation-in-part of U.S. Non-provisional application Ser. No. 15/950,676, filed Apr. 11, 2018, to the extent allowed by law and the contents of which are incorporated herein by reference in their entireties.

TECHNICAL FIELD

This disclosure relates to bit/bit holder combinations and, more particularly, to such a combination utilizing a larger ballistic tip insert with at least one heat transfer bore.

BACKGROUND

As basic infrastructure created in the 20th Century ages and wears, machinery for rejuvenating or replacing that infrastructure has become more important. While mining and trenching operation machinery may be included in this technology, road milling machinery, down hole tools in the oil well industry, and other similar industries area, thus far, the most prolific use of the instant machinery.

Road milling equipment utilizes a rotating drum having a plurality of bit assemblies removably mounted on the outside of the drum in spiral or chevron orientation. A typical rotating drum has a bit tip to bit tip diameter of between 42 and 54 inches and includes a plurality of mounting blocks generally secured thereto by welding in spiral or chevron patterns. The patterns noted provide for the bit blocks to be mounted behind and slightly axially to the side of one another such that the bits or combination bit/holders mounted in each bit block may have the tips of the bits positioned in close proximate relation along the axial length of the drum. As such, adjacent bit tips may be positioned anywhere from about 0.200 inch to about ⅝ inch axially apart for either removing concrete, asphalt, or the like, when replacing one or both of the pavement and underlayment for roadways, or may be positioned axially closer together, about 0.200 inch, for micro milling the surface of pavement to remove buckles, create grooves on curved surfaces such as cloverleafs, or the like.

Improvements in the bits and bit/holders that are removably mounted on the bit blocks have increased the useful in-service life of those removable parts. While such bit and bit/holders have been made of steel and hardened materials such as tungsten carbide, the use of diamond coated tips and man-made PCD (polycrystalline diamond) tips, has been shown to increase the in-service life of those bits and bit/holders.

Another improvement in bit/holders has been the invention of quick change holders that have eliminated the necessity of securing such holders with threaded nuts or retaining clips and have utilized the compressive elastic ductility of hardened steel to provide sufficient radial force between the holders and the bit block bores to retain holders mounted in their respective bit block bores during operation. While such bit assemblies have included rotatable and removable bits mounted in bit holders which, in turn, were mounted in bit blocks as noted above, the introduction of diamond materials on bit tips has increased their in-service life 40 to 80 times and has, in some cases, allowed for the combining of bits and bit holders into a unitary construction with the tips no longer being rotatable on the holders.

A need has developed for improved structure at the front leading end or tip end of bit/holders that provide for improved wear characteristics, in-service life and finer milled road surfaces at reduced total cost. To prolong the life of a bit tip insert at the tip end, at least one bore is provided within the bit tip insert. The at least one bore is adapted to allow for inward contraction and/or movement when diamond coated tip distributes heat generated at the cutting tip and transfers the heat into the base of the bit tip insert during cutting operations. The at least one bore prevents less outward expansion of the tungsten carbide portion of the bit tip insert in the direction of the diamond coating and thereby prevents the expanded tungsten carbide from fracturing the diamond coating of the bit tip insert. For bit tip inserts without diamond coatings, the at least one bore prevents less outward expansion of the tungsten carbide of the bit tip insert in the direction of the tip and thereby prevents the expanded tungsten carbide from fracturing the tip of the bit tip insert.

SUMMARY

This disclosure relates generally to bit and/or pick assemblies for road milling, mining, and trenching equipment. One implementation of the teachings herein is a bit tip insert that includes a body comprising a tip and a base subjacent the tip; and a first bore axially extending from a distal end of the body to a first bore termination disposed within one of the base and the tip, the first bore adapted to allow inward contraction when the tip transfers heat into the base during operation.

These and other aspects of the present disclosure are disclosed in the following detailed description of the embodiments, the appended claims and the accompanying figures.

BRIEF DESCRIPTION OF THE DRAWINGS

The features of the present disclosure which are believed to be novel are set forth with particularity in the appended claims. The disclosure may best be understood from the following detailed description of currently illustrated embodiments thereof taken in conjunction with the accompanying drawings wherein like numerals refer to like parts, and in which:

DETAILED DESCRIPTION

The diameter of the base of the PCD ballistic insert is determined by the required geometric profile of the forward end of the point attack tool. As the machine or equipment size diminishes, so does the amount of horsepower of the engine or the machine needed to operate the machine.

The ballistic or parabolic style profile of the tip of the PCD insert provides a longer conic tip than a standard straight line side profile of a frustoconical tip. The longer parabolic tip has a greater PCD coated length with more structural strength. The included angle of the tip varies axially. Sollami PCD tool is 180 degrees indexable to achieve extended life over prior art diamond coated tools, while maintaining nearly exactly the same cut surface profile.

Figure 1:
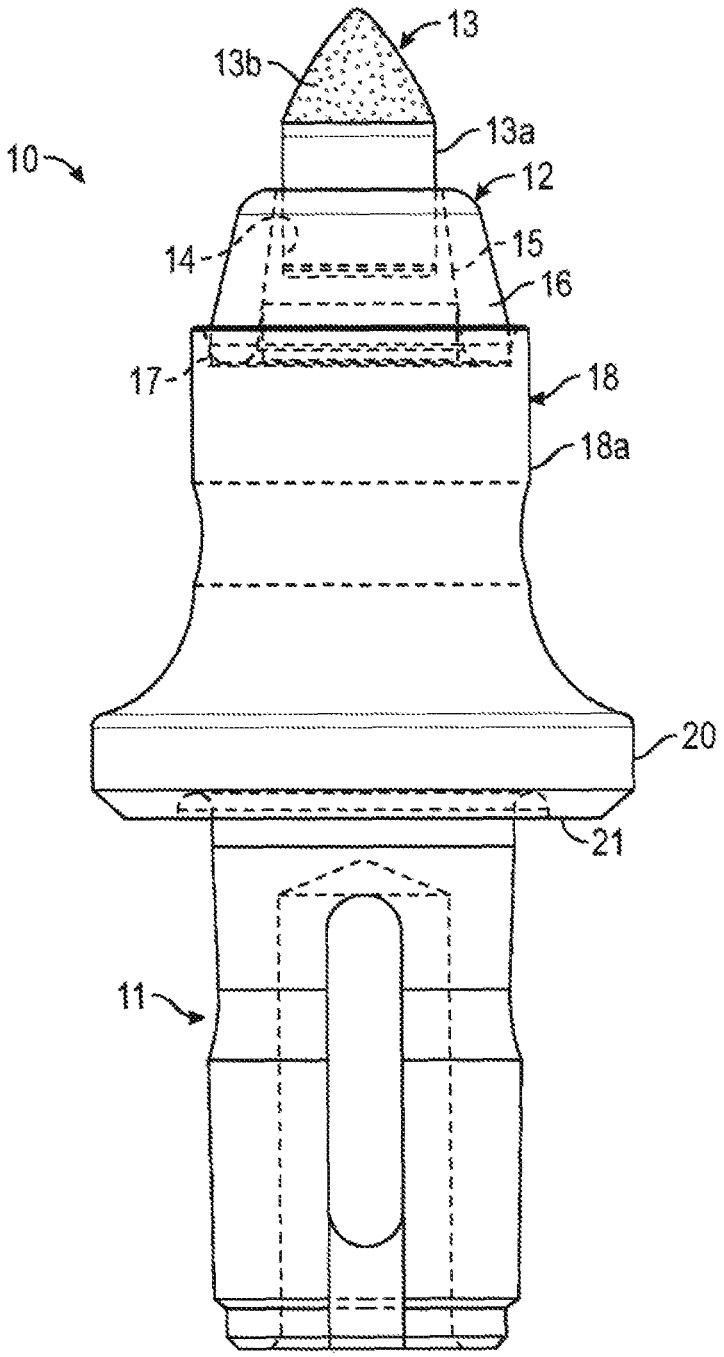
FIG. 1 is a front elevational view of a first embodiment of a bit/holder constructed in accordance with the present disclosure including a first embodiment of an improved and enlarged leading tip section.

Referring to FIGS. 1 and 2, a first embodiment of a bit/holder 10, constructed in accordance with the present disclosure, includes features from this inventor's previous U.S. Pat. Nos. 6,371,567, 6,585,326 and 6,739,327 which show both the shank 11 at the rear of the bit/holder and the forward end 12 of the bit/holder 10 having a diamond coated tungsten carbide tip insert 13 mounted in a generally cylindrical recess 14 at the center of an annular flange 15 extending axially outwardly from the steel body portion of the bit/holder. This steel annular flange 15 provides ductility and shock absorption characteristics to the generally ballistic shape tip 13 that is preferably made of tungsten carbide having either a single 13*b* or multiple layer (See FIG. 6) of industrial diamond or PCD superstructure over the forward conical portion of the tip. Additionally, an annular ring 16 of tungsten carbide is mounted over the steel annular flange 15 for added wear resistance to the aft portion of holder. The tungsten carbide annular ring 16 is preferably brazed in an annular groove 17 at the top of the body portion 18 of the holder 10.

In the illustrated embodiment of the bit/holder 10 when used for road milling purposes, the nominal outer diameter of the shank 11 is about 1.5 inches and the nominal outer diameter of the widest portion of the body 18 of the holder is about 2⅝ inches at what is termed the "tire portion" 20 of the holder body 18. The diameter of the upper cylindrical portion 18*a* of the body 18 is about 1¾ inches and the axial length of the body from the rear annular flange 21 to the front of the cylindrical portion is about 3 inches. The length of the shank 11 in the embodiments shown approximates 2½ inches. As taught in my U.S. Provisional Patent Application No. 61/944,676, filed Feb. 26, 2014, now U.S. Non-provisional patent application Ser. No. 14/628,482, filed Feb. 23, 2015, and now U.S. Patent Application Publication No. 2015/0240634, published Aug. 27, 2015, the contents of which are incorporated by reference, bit holder shanks may be shorter, on the order of 1½ inches.

With the forward cylindrical end of a bit holder body 18 having a diameter of about 1¾ inches, prior art bits or pick bolsters have been designed to have a conical surface aiding in diverting pavement material away from the forward tip portion of the bit/holder or bit.

In designing these structures, tip inserts having a front conical tip of PCD or diamond layered material 13*b*, as shown in FIG. 1, have been selected to provide best results. The diameter of the tip insert at its widest point for holders sized as above has thus far been a tip insert made to a base diameter of about 0.565 inch. In experimenting with such diamond covered tip insert structures, applicant has discovered that using such a tip having a nominal diameter of 0.625, 0.75, 0.875 inch or larger ballistic tip insert may still be inserted in a modified structure substantially similar to that previously shown in U.S. Pat. No. 6,739,327. Thus, the improvement is also compatible with existing drums and bit holder blocks. This illustrated ¾ inch or larger diameter ballistic shaped tip insert 40 is also longer (See FIG. 6) in overall length than the 0.565 inch diameter prior insert utilized.

Figure 4:
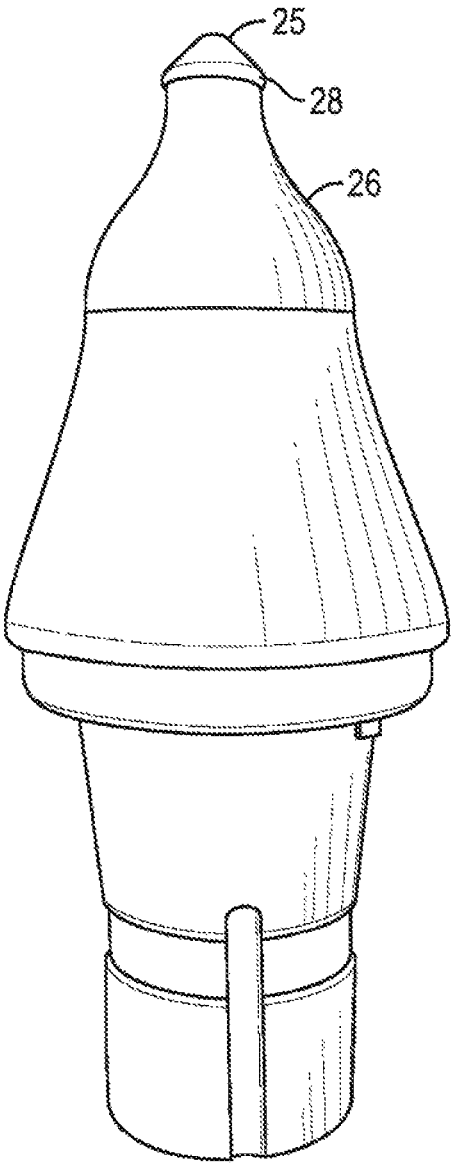
FIG. 4 (Prior Art)
FIG. 4 is a photograph showing a front elevational view of a prior art bit/holder after substantial in-service use showing the wear characteristics on it after substantial use.
Figure 5:
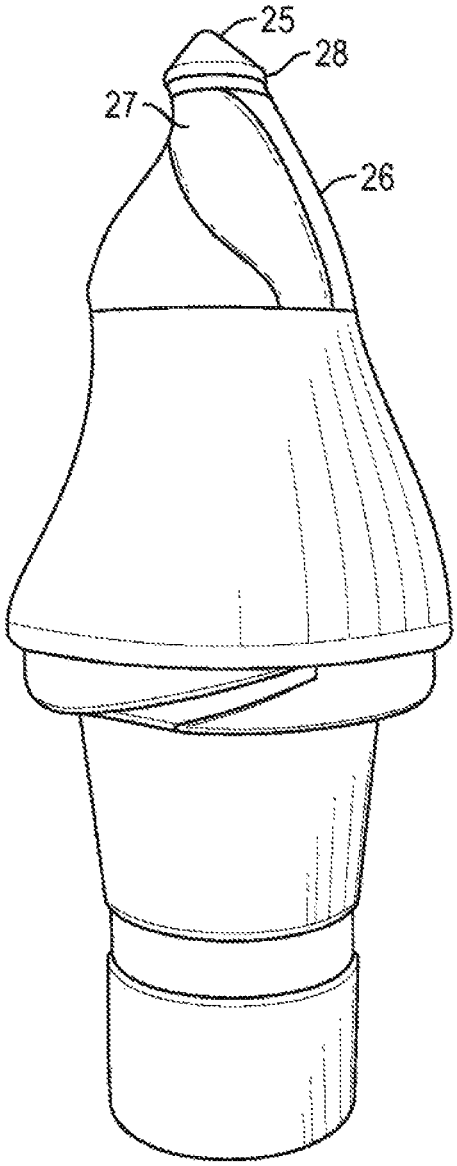
FIG. 5 (Prior Art)
FIG. 5 is a photograph showing a side elevational view of the prior art bit/holder shown in FIG. 4 wherein separated material has flowed past the left side of the bit/holder in use.

The overall length of the ¾ inch diameter ballistic tip insert is about 1⅛ inches. This length when mounted in the cylindrical recess 14, having a diameter of at least 0.625 inch, at the front of the bit holder body 18 allows the ballistic tip insert 13 to extend at least ⅝ inch from the front of the annular tungsten carbide collar 16 and to extend at least ½ inch outwardly of recess 14. When coating tungsten carbide inserts with diamond, high temperature, high pressure presses are used. Making more 0.565 diameter inserts has thus far yielded slightly cheaper inserts, but applicant has found that making fewer, larger inserts per manufacturing operation at cycle yields better milling results, although each insert is made at a slightly higher cost. Referring to FIGS. 4 and 5, the wear pattern of a prior art PCD insert tip 25 attached to a tungsten carbide bolster bit/holder 26 of prior art 0.565 inch tip diameter is shown. The conical portion of the ballistic tip insert 25 shows some wear after substantial use of the tool. Most of the wear occurs immediately aft 27 of the widest part 28 of the tip insert. This wear occurs in the product shown on both sides in FIG. 4 and on the left (loosened material flow side in FIG. 5) in what is termed a "tungsten carbide bolster" 26 that initially is generally frustoconical in shape with a slightly convex worn outer surface. The right side of the tip 25 in FIG. 5 slides along the remaining roadway material. As shown in FIGS. 4 and 5, this PCD conical front tip 25 extends minimally away from the front of the tungsten carbide bolster 26. It is submitted that the additional ⅝ inch extension of the improved ¾ inch or larger diameter ballistic tip insert of the present disclosure urges removed asphalt and concrete material away from the tip 13 at the area of most wear (the left side of FIG. 5 in the prior art) and thus provides reduced wear on the annular ring.

Figure 2A:
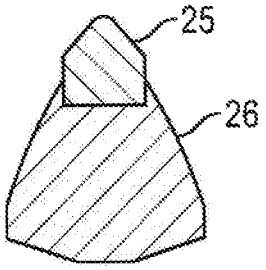
FIG. 2A (Prior Art)
FIG. 2*a* is a cross section view of a prior art 0.565 inch PCD tip insert mounted on a recess in a pick bolster.
Figure 2B:
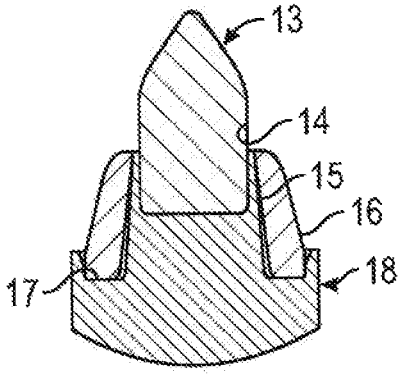
FIG. 2*b* is a fragmentary cross section view of the 0.75 inch diameter PCD layered tip insert as in FIG. 1 shown for comparison purposes with the prior art disclosed on the other FIG. 2 drawings.

Referring to FIGS. 2*a*, 2*b*, 2*c* and 2*d*, the bit tip insert 13 of the disclosure shown in FIG. 2*b* is compared with prior art 0.565 inch diameter conical tips shown in FIG. 2*a*. The added diamond coated conical area of the new tip 13 of FIG. 2*b*, shown in FIG. 2*c* solid line 13 at the sides of the prior art tip of FIG. 2*a* at 25, provides substantially greater diamond protected cutting area than the prior art. This added area, when used on neighboring like sized tips, on ⅝ inch center-to-center drums, provides substantial cutting overlap on pavement to be milled.

Figure 2C:
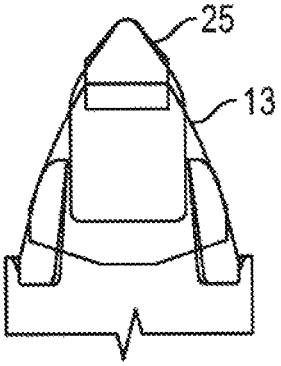
FIG. 2*c* is a diagram view showing the prior art tip of FIG. 2*a* superimposed on the front portion of the enlarged tip of FIG. 2*b;*
Figure 2D:
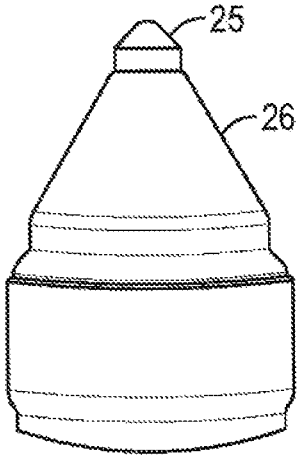
FIG. 2D (Prior Art)
FIG. 2*d* is a fragmentary photograph of another prior art tip having a 0.565 inch diameter conical distal end.

FIGS. 2*a* and 2*d* show prior art 0.540 to 0.565 inch PCD inserts 25 which have conical PCD tips brazed to tungsten carbide bases mounted on a pick bolster 26 made of tungsten carbide.

FIG. 2*c* shows the outlines of tip insert 13 of the present disclosure as mounted in a bit holder with the prior art 0.565 tip and bolster of FIG. 2*a* superimposed at 25 thereon. As in FIG. 2*b*, the added (enlarged) diamond coated conical portion over this piece of prior art can readily be seen with similar advantages as discussed above. The profiles toward the top of the bit insert are similar, but the height of the tapered portion is greater than a 0.565 inch PCD tip producing better wear protection to the annular carbide ring as will be discussed below.

FIG. 2*d* shows another prior art 0.565 diamond tip insert 25. Applicant's 0.75 inch conical tip insert would provide similar advantages over this tip as mentioned in connection with FIG. 2*c* above.

Figure 3:
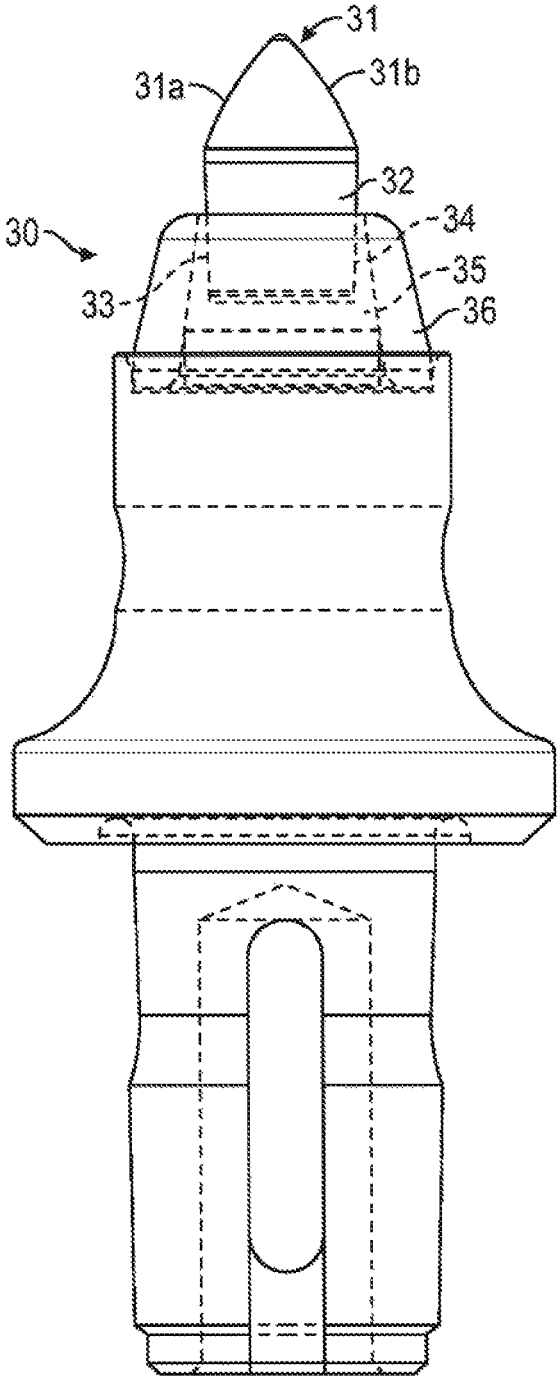
FIG. 3 is a front elevational view of a second embodiment of a bit/holder constructed in accordance with the disclosure showing a second embodiment of a tip having a slight reverse taper in the aft or body portion thereof which is mounted on the front of the holder portion thereof.

FIG. 3 shows a second embodiment of a bit/holder 30 of the present disclosure utilizing a 0.75 inch nominal diameter diamond covered conical tip 31 with a tungsten carbide base 32 that is slightly reverse tapered at its sides 33, 34 at approximately a 2 degree half angle in this illustrated embodiment, that is, 2 degrees per side. In other embodiments, the tungsten carbide base 32 is slightly reverse tapered at its sides 33, 34 in the range of and including 1/100 of 1 degree to 15 degrees per side).

While prior art bits and bit/holders disclose an enlarged tungsten carbide conical portion just aft of the 0.565 inch base insert with PCD shaped tip, the present disclosure, having a steel annular tubular column 35 having a recess 37 (FIG. 3) into which the 0.75 diameter PCD insert 31 is inserted, provides additional shock absorbing characteristics as a result of the ductility of the steel and subjacent braze joint. Prior art PCD tungsten carbide inserts brazed to tungsten carbide bases do not possess those shock absorbing capabilities. The central steel annular tubular column 35 also provides for greater thermal expansion and contraction during use. As the forward end of the PCD insert 31 increases its working temperature, the steel column 35 and the braze joint will expand about twice the amount of tungsten carbide expansion for the same increase in temperature and radially grab the PCD insert 31 more securely. The carbide collar 36 restricts the steel column 35 from similarly expanding outwardly. The steel tubular column 35 has about twice the coefficient rate of thermal expansion value as tungsten carbide.

Thus, improved bit/holders 10, 30, utilizing a ballistic shape tip of an increased diameter from 0.565 inch to 0.75 inch and larger provides a superior product than previously known in the art while still being usable with present size bit holder blocks (not shown).

Figure 6:
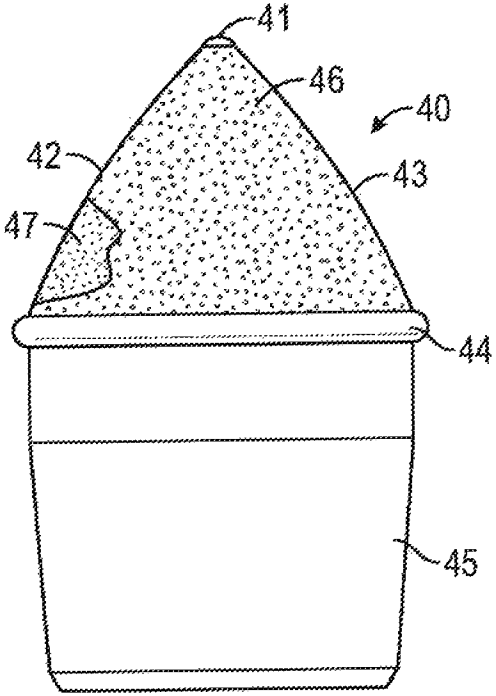
FIG. 6 is an enlarged diagrammatic elevational detail view of a third embodiment of the enlarged tip insert.

Referring to FIG. 6, a third embodiment of a ballistic shaped diamond coated tungsten carbide insert 40 is shown. A tip such as shown in the first embodiment could include a frustoconical tip having an approximately ⅛ inch curved radius at the top 41 thereof, and straight or parabolic conical sides leading down to the widest part of the base 44. Also, the tip 13 shown in the first embodiment has a cylindrical base 13*a* that extends at least about ¾ inch behind the generally conical tip 13, which fits into the cylindrical recess 14 at the top of the body 18 of the holder 10 in the first embodiment and is brazed into recess 14.

In the second embodiment of the bit/holder 30, the tip 31 shown in FIG. 3 and the third embodiment of the tip 40 of FIG. 6 also include an approximate ⅛ inch curved top. The sides 31*a*, 31*b* (FIG. 3) of the conical portion of the insert are parabolic in shape. An additional ⅛ inch thereafter, the parabola shape changes to a 60½ degree separation and another ⅛ inch down from there the separation changes to an approximate 51 degree separation.

The parabolic shape of the ballistic tip 31 provides more mass under the multi layered diamond coating than would a straight side conical tip. Additionally, the top of the parabolic tip 31 provides improved separation of the material removed from the base thereof and directs the material removed further away from the base of the tip.

As shown, the base 32 of the tip 31 in the second embodiment is ¾ inch in diameter and in the second embodiment includes a 2 degree per side taper toward the bottom of the insert which is about a total 1 inch to 1.5 inches in height.

As mentioned previously, it appears from the drawing shown in FIG. 3, that an important factor for wear in the bit/holder is the width of the base of the tip in the insert. While prior art inserts have been approximately 0.565 inch in diameter, increasing that diameter to 0.75 inch and larger provides a wider base at the point of greatest wear during use of such a bit/insert. Thus the use of a 0.75 inch or greater diameter insert base provides for greater longevity of use. Also, larger bit holders are utilized for trenching and mining operations, so larger bit inserts can be utilized there. Further, the increased length of the insert to 1 inch in length or greater allows at least a ⅝ inch exposed length of the insert that also directs material removed away from the base of the insert to decrease the wear in what FIGS. 4 and 5 show as the most sensitive part of the wear for a bit/holder during use.

The third embodiment of the diamond coated tip 40 shown in FIG. 6 differs from that shown in FIG. 3 in that the diamond coating 46 includes a ridge or overfill portion 44 at the base of the parabolic curves 42, 43 that has a thickness of about 0.010 inch or more per side. The overfill or over formed portion 44 may not be regular in shape and does not need to be ground or removed into any specific shape. This added diameter also affects the shape of the finished surface as will be discussed in more detail below. Depending upon the grade of diamond material or PCD material used, this thickness of the diamond coating may typically be about 0.120 inch or less. Multiple layers of diamond coating 46, 47, as shown in FIG. 6, may be overlayed on the bit tip 40. It should be noted that with the greater diameter and outward extending diamond edge overfill 44 of the increased tip 40 shown in FIG. 6, a thinner diamond or PCD coating at 46, 47 may be utilized in adjusting wear characteristics vs. cost. It should be noted that the conical area of a 0.75 inch diameter cone at the tip includes over 3.5 times the area of a 0.565 inch tip, providing a substantially more massive cutting tool.

Figure 7:
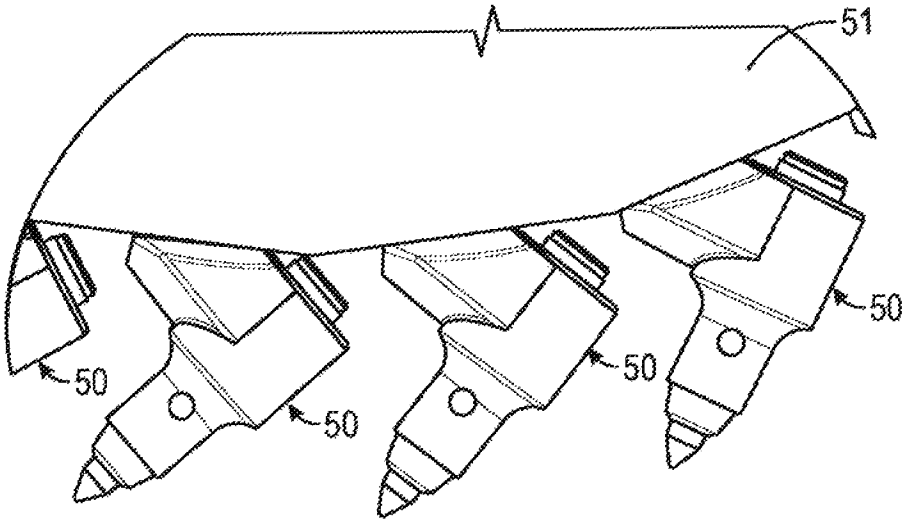
FIG. 7 is a diagrammatic stop motion side view of the partial sweep of a bit assembly as it moves through its material separating operation.
Figure 8:
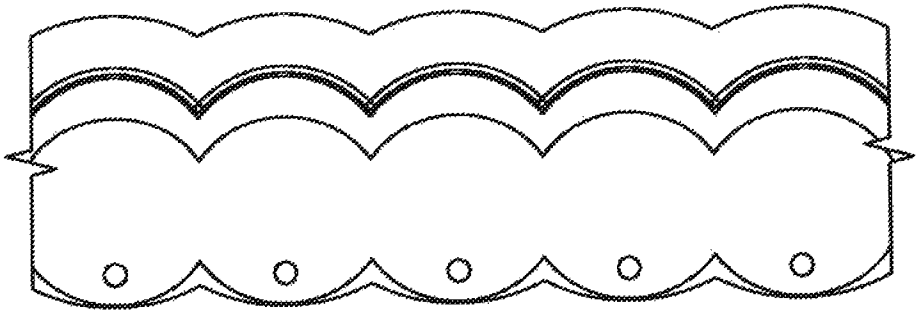
FIG. 8 is a diagrammatic front view taken at 90 degrees to FIG. 7 showing the added side overlap of successive bit assemblies resulting in a finer finish cut using a drum with standard 0.625 inch center-to-center tip spacing.

Referring to FIGS. 7 and 8, a plurality of cutting tools 50-50, constructed in accordance with the present disclosure, are shown sweeping across the cutting area of a surface to be removed. As previously described, the increased outer diameter of the bit tip to 0.75 inch adds mass to the exact area where most wear during use occurs. This increased cross section creates a shallow depth pattern as needed in micro milling, without requiring additional machine horsepower.

As previously discussed, a plurality of these bit assemblies 50-50 are mounted on cylindrical drum 51 in spiral or chevron fashion. A typical drum being about 7 feet to about 13 feet in length and typically 42 to 54 inches in diameter, may hold around 168 to 650 bit assemblies with center-to-center axial spacing of 0.625 inch between bit assemblies. This is in what is termed a "standard drum" previously used for removal of not only surface material, but also substrate material. Previously, drums used for micro milling have had center-to-center tip axial spacing of 0.20 inch between tips. As such, drums used for micro milling may have about 325 bit assemblies for same 7 feet 2 inch length drum. This is in drums term "double or triple hit drums," double hit drums may have about 25 percent more of the bit assemblies. Full lane micro milling drums that are about 13 feet in length may have 600 to 900 bit assemblies per drum at a 0.200 inch center-to-center axial tip spacing.

Applicant has found that the use of ¾ inch nominal diameter or larger diamond coated bit tips when used at ½ to 1 inch depth of cut at approximately 92 rpm drum rotation speed and at a travelling speed of 20-40 ft/min may provide a surface approaching or equal to the flatness of a micro milled surface previously obtained with 0.565 inch diameter bit tips on drums having 0.200 inch center-to-center bit separation with same machine cutting specifications.

FIG. 8 shows a diagram of succeeding 0.75 inch bit tips of the present disclosure spaced at 0.625 inch apart which gives an axial overlap between adjacent bit tips of about 0.125 inch. This overlap is also at the point of most vertical curvature for even a ½ inch depth of the cut, leaving a substantially flatter surface than would be obtained using the 0.565 inch diameter bit tips. The fineness of the residual surface is also obtained by moving the drum at a slower speed (15-25 fpm). The faster in feet per minute the drum travels forward, the rougher the cut. It is therefore necessary not to outrun the cut. A speed of 60-120 feet per minute is considered normal for a rough cut.

As noted, the resulting fineness of the surface milled using the larger diameter bit tip approaches or achieves micro milling flatness by utilizing standard center-to-center diameter drums instead of the more expensive drums presently made for micro milling operations. Additional fineness of cut can be achieved by modifying spacing to somewhat less than 0.625, but substantially greater than 0.2 inch center-to-center. Not only is the cost of the drum less, but utilizing fewer bit assemblies makes a lighter drum requiring less horsepower to operate with more fuel efficiency and less impact on the machine components.

Figure 9:
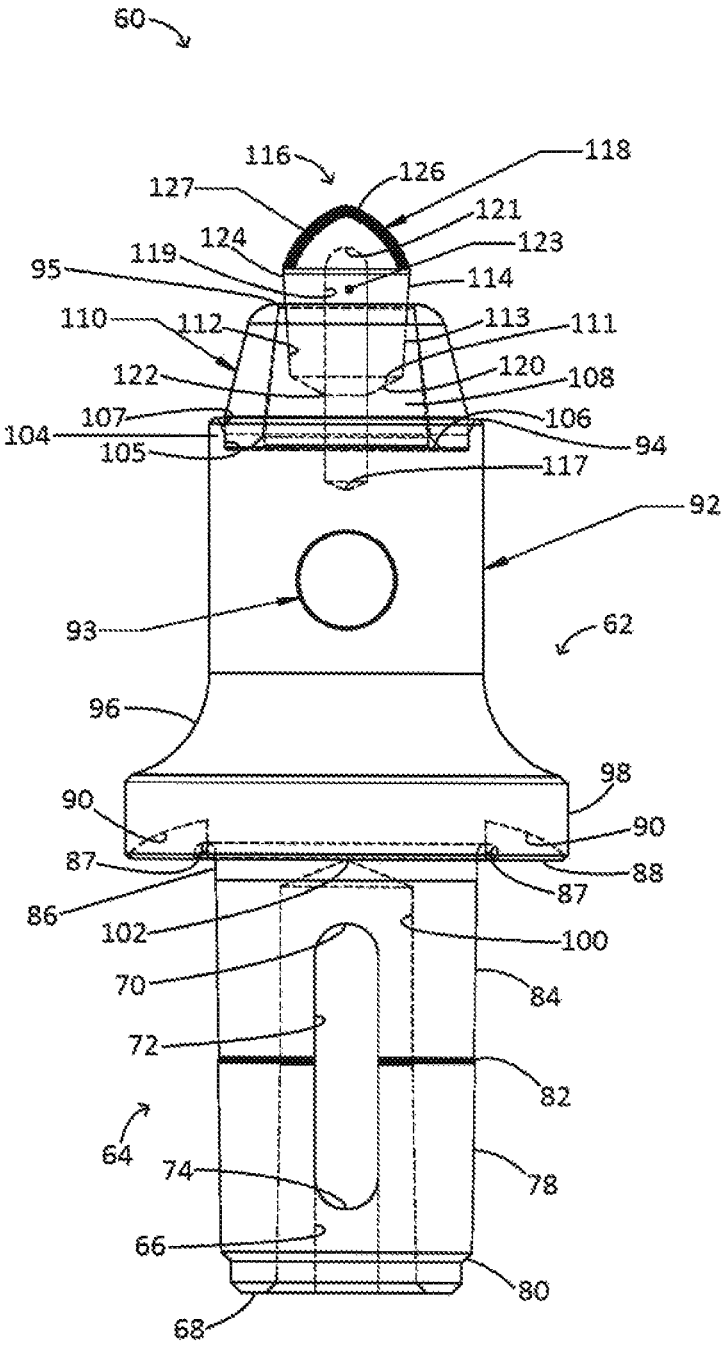
FIG. 9 is a side elevation view of a third embodiment of a bit/holder and a fourth embodiment of a tip insert in accordance with implementation of this disclosure.
Figure 10:
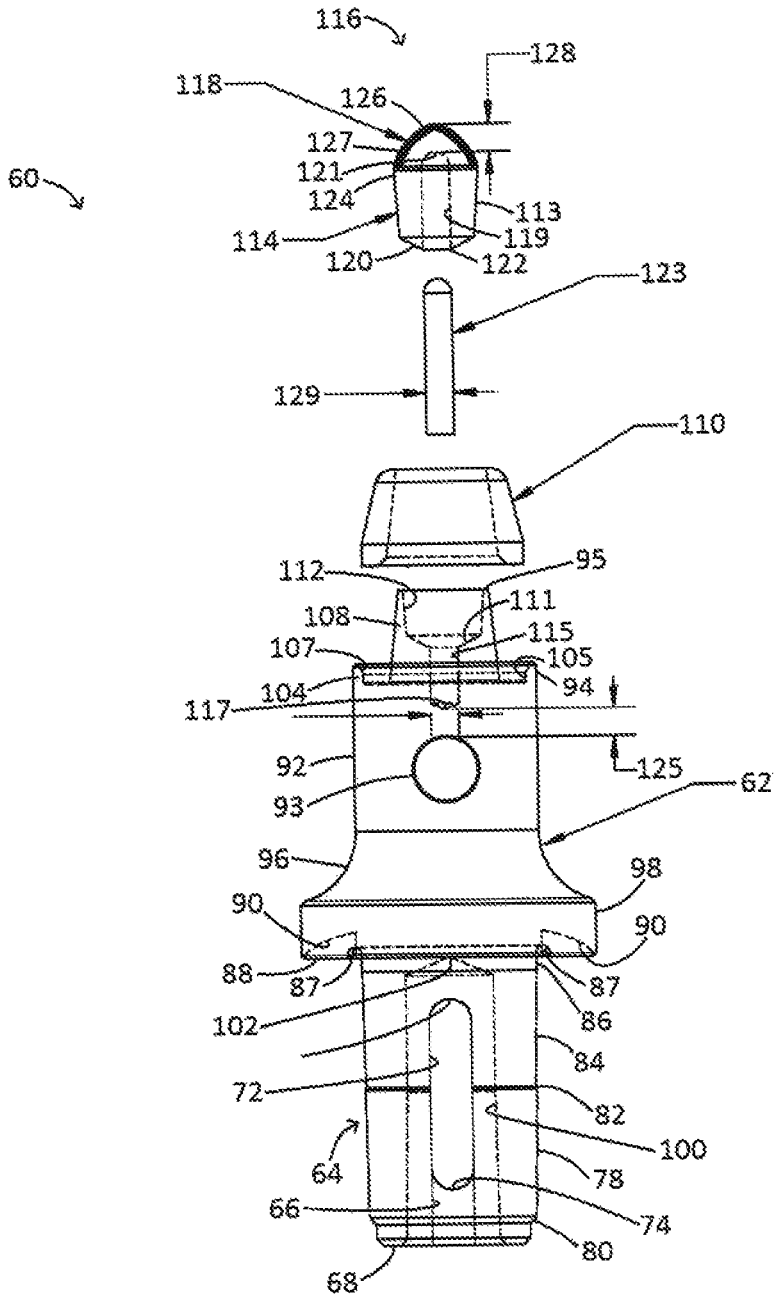
FIG. 10 is an exploded side elevation view of the third embodiment of the bit/holder and the fourth embodiment of the tip insert in accordance with implementations of this disclosure.

Referring to FIGS. 9 and 10, a fourth embodiment of a generally conical tip insert 116, that includes a parabolic curved section below an apex of the tip insert 116, in a third embodiment of a bit/holder 60 of the present disclosure is shown. The bit/holder 60 is a unitary bit and bit holder construction that includes a body 62 and a generally cylindrical hollow shank 64 axially depending from a bottom of the body 62. The shank 64 includes an elongate first slot 66 extending from a generally annular distal end 68 of the shank 64 axially upward or forward to an upper termination 70 adjacent the upper or forward end of the shank 64. In this embodiment, the shank 64 also includes an internally oriented second slot 72 located approximately 180 degrees around the annular shank 64 from the first slot 66. This second slot 72 is parallel to the first slot 66 and is an internal slot having a rearward semicircular termination 74 inwardly adjacent to the distal end 68 of the shank 64 and a forward semicircular termination 76 (not shown) generally coinciding longitudinally and axially with the upper termination 70 of the first slot 66.

In this illustrated embodiment, the shank 64 includes a lower or first tapered portion 78 running axially from a stepped shoulder 80 adjacent the distal end 68 of the shank 64. The stepped shoulder 80 is disposed between the lower tapered portion 78 and the distal end 68. A diameter of the stepped shoulder 80 increases, or steps up, as it axially extends from the distal end 68 to the lower tapered portion 78. The first tapered portion 78 runs upwardly or axially from the stepped shoulder 80 of the shank 64 and terminates generally mid slot 66 longitudinally. The shank 64 also includes an annular shoulder 82 separating the lower tapered portion 78 from an upper or second tapered portion 84 which extends from the shoulder 82 to generally adjacent to the top of the shank 64 or forward terminations 70, 76 of slots 66, 72, respectively. The annular shoulder 82 is disposed between the lower tapered portion 78 and the upper tapered portion 84. A diameter of the annular shoulder 82 decreases, or steps down, as it axially extends from the lower tapered portion 78 to the upper tapered portion 84. A generally cylindrical top portion 86 of the shank 64 extends from a position adjacent the top or upper terminations 70, 76 of slots 66, 72, respectively, towards a generally annular back flange 88 that denotes the base or bottom of the body 62 of the bit/holder 60. The top of the shank 64 may include a rounded junction 87 between the top portion 86 of the shank 64 and the generally annular flange 88 of the body 62 of the bit/holder 60, which is provided to avoid sharp corners which may provide an area for stress cracks to begin.

The generally annular flange 88 includes a pair of horizontal slots 90-90 generally perpendicular to the longitudinal axis of the combination bit/bit holder, one on either side of the generally annular flange 88. The horizontal slots 90-90 are configured to receive a pair of bifurcated fork tines that may be inserted between the base of the body 62 of the bit/holder 60 and a base block (not shown) into which the shank 64 of the bit/holder combination is inserted and retained by outward radial force in use.

A central bore 100 longitudinally and axially extending through the shank 64 of the bit/holder 60 combination terminates at bore termination 102, which in this illustrated embodiment has a conical shape, which is approximately at the upper end of the shank 64. This allows the generally C-shaped annular side wall of the shank 64 to radially contract when the shank 64 is mounted in a tapered or cylindrical bore in a base block (not shown).

In this third illustrated embodiment of the bit/holder 60, the bit holder body 62 includes an generally cylindrical or annular upper body portion 92 depending from a forward end 94 of the upper body portion 92. Optionally, a mid-section of the upper body portion 92 of the bit/holder 60 may include a cross or through hole 93 substantially perpendicular to the longitudinal axis of the bit/holder 60. This cross hole 93 extends horizontally through the upper body portion 92 and forms a receiver for a drift pin (not shown) used in connection with the cup portion of a bit/holder insertion tool. In an alternate embodiment, the upper body portion 92 of the bit/holder 60 may not include a cross or through hole. A mediate body portion 96 subjacent the upper body portion 92 generally slopes axially and radially outwardly to a radially extending generally cylindrical tire portion 98.

The bit holder body 62, in order to provide superior brazing of a tungsten carbide ring 110 to the forward end 94 of the upper body portion 92, includes a forwardly extending annular collar 104 that is created on the bit holder body 62 to provide an annular trough 106 around a tapered forward extension 108 of the bit holder body 62 onto which the annular ring 110 is mounted. In this illustrated embodiment, the annular collar 104 includes a cylindrical bottom inner wall 105 and a tapered top inner wall or countersink 107. The vertical outer wall of the collar 104 will keep brazing material from flowing outwardly of the joinder between the base of the ring 110 and the annular trough 106 on which the ring 110 is positioned. The annular trough 106 is thereabout positioned perpendicular to the axis of the bit/holder 60 from the interior of which axially extends the smaller radially oriented annular tapered upper or forward extension 108. Around this tapered forward extension 108 is fitted the annular tungsten carbide ring 110, seated in the annular trough 106, which may be brazed into unitary construction with the remainder of the bit/holder 60. The top or forward-most portion of the tungsten carbide ring 110 and the annular tapered forward extension 108 of the upper body portion terminate generally at a forward end 95 of the bit holder body 62 of the combination bit/holder 60.

With the bit holder body 62 of the present disclosure in this embodiment made of 4340 or equivalent steel, the top of the forward extension 108 of the bit holder body 62 includes a radially declining tapered bore 112, or a generally cylindrical bore in other embodiments, extending from the co-terminal upper wall of the body axially inwardly thereof which defines, in this illustrated embodiment, a radially declining taper. In other embodiments, the bore can also have a hollow generally cylindrical shape or a slight draw or draft angle. The bore 112 extends a short distance longitudinally axially inwardly of the forward extension 108 to define a base 111 for the tip insert base 114. The base 111, in this illustrated embodiment, has a frustoconical shape. The bit holder body 62 also includes a bore 115 that axially extends from the base 111 of the bore 112 to a bore termination 117, which in this embodiment is conical shaped, within the upper body portion 92 of the bit/holder 60 adjacent the annular trough 106.

The tapered bore 112 provides a space for receiving a complementary shaped declining tapered outer surface 113 of the base 114 of the tip insert 116 for the bit/holder combination. In one exemplary implementation of the fourth embodiment, the tip insert 116 can have a diameter in the range of ⅝ inch to 1¼ inch. In this fourth embodiment, the base 114 includes a tapered portion 120 adjacent a distal end 122 of the base 114. The base 114 may be made of steel or tungsten carbide and includes a tip 118 at an outer or forward end 124 of the base 114. The tip 118 can have a frustoconical shape, a flat generally cylindrical puck shape, a parabolic ballistic shape, and/or an arcuate shape. In this illustrated embodiment, the tip insert 116, comprising the base 114 and the tip 118, goes through a sinter-HIP process that comprises a vacuum sinter with a post hot isostatic pressure (HIP) operation where the carbide of the tip insert 116 is first heated in a vacuum furnace at vacuum. At the end of the first vacuum sinter process, the vacuum is replaced by pressurized argon gas of many atmospheres, such as 10,000-40,000 PSI, which creates a sealed envelope of molten binder metals, such as cobalt, around the carbide.

In this embodiment, an overlay 127 of a polycrystalline diamond structure is applied to an outer surface or forward end 126 of tip 118. The overlay 127 may also be made of an industrial diamond material and may be a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature process (HPHT). The sinter-HIP tip insert 116, which includes the tip 118 and the base 114, and the overlay 127 on the forward end 126 of the tip 118 are centered and placed in a can or metal enclosure and a plurality of hydraulic pistons apply pressure and force on the can over time during the HPHT process, compressing and/or pressing the tip 118 and base 114 again. The HPHT process liquefies the binder material, such as cobalt in this embodiment, which migrates toward the overlay 127 and binds to the diamond and tungsten carbide producing a stronger form. The diamond to diamond bond in the overlay 127 and tip 118 is created by the catalytic attachment of the cobalt within the small cavities of diamond crystals in the overlay 127. The overlay 127 occupies a large radial and axial profile of the tip 118 which allows faster heat transfer into a region subjacent to the overlay 127 PCD layer. Excessively high heat, such as temperatures above 1300 degrees F., is the greatest cause of PCD failure due to diamond connective failure, the quick heat transfer from the tip 118 of the PCD cutting zone, which is approximately ½ inch depth of cut per tip engagement, to the subjacent region below the PCD drastically reduces the possibility of a temperature of the tip 118 of the PCD reaching temperatures at or above 1300 degrees F. for any extended period of time thereby avoiding failure of the PCD layer.

The tip insert 116 further includes a bore 119 that axially extends from the distal end 122 of the tip insert 116 to a bore termination 121, which in this illustrated embodiment, has a rounded shape and is located within the tip 118 adjacent an apex thereof. In other embodiments, the bore termination 121 may have various other shapes, such as a conical shape and a frustoconical shape, and may be located within the base 114 and/or adjacent the tip 118. The bore 119, in this embodiment, is formed by a wire-cut electrical discharge machining (EDM) process that removes material from the tip insert 116 by a series of rapidly recurrent discharges between two electrodes separated by a dielectric liquid and subject to an electric voltage. In this illustrated embodiment, the bore termination 121 is approximately a minimum distance 128 (FIG. 10), which may be approximately 3/16 inch, from the apex of the tip 118. The bore 115 and the bore 119 are adapted to receive an insert 123 made of a high heat transfer of conductor material, such as copper or stainless steel in this illustrated embodiment. The insert 123 may be a generally cylindrical solid piece with a rounded forward end, at least one generally cylindrical hollow piece, and/or at least one generally cylindrical tubular piece. The bore 115, the bore 119, and the insert 123 can vary in diameter 129 (FIG. 10) depending on the size of the tip insert 116. A depth 125 (FIG. 10) that the insert 123 axially extends into the upper body portion 92 of the bit/holder 60 is sufficient to transfer and/or disperse heat from the overlay 127. In an exemplary implementation of the fourth embodiment, the bore 119 can have a diameter of approximately 3/32 inch that is adapted to receive a generally cylindrical tubular first insert 123 having an outer diameter no greater than 3/32 inch and an inner diameter of approximately 1/32 inch, the inner diameter of the tubular first insert 123 adapted to receive a generally cylindrical tubular second insert 129 having an outer diameter no greater than 1/32 inch.

Figure 11:
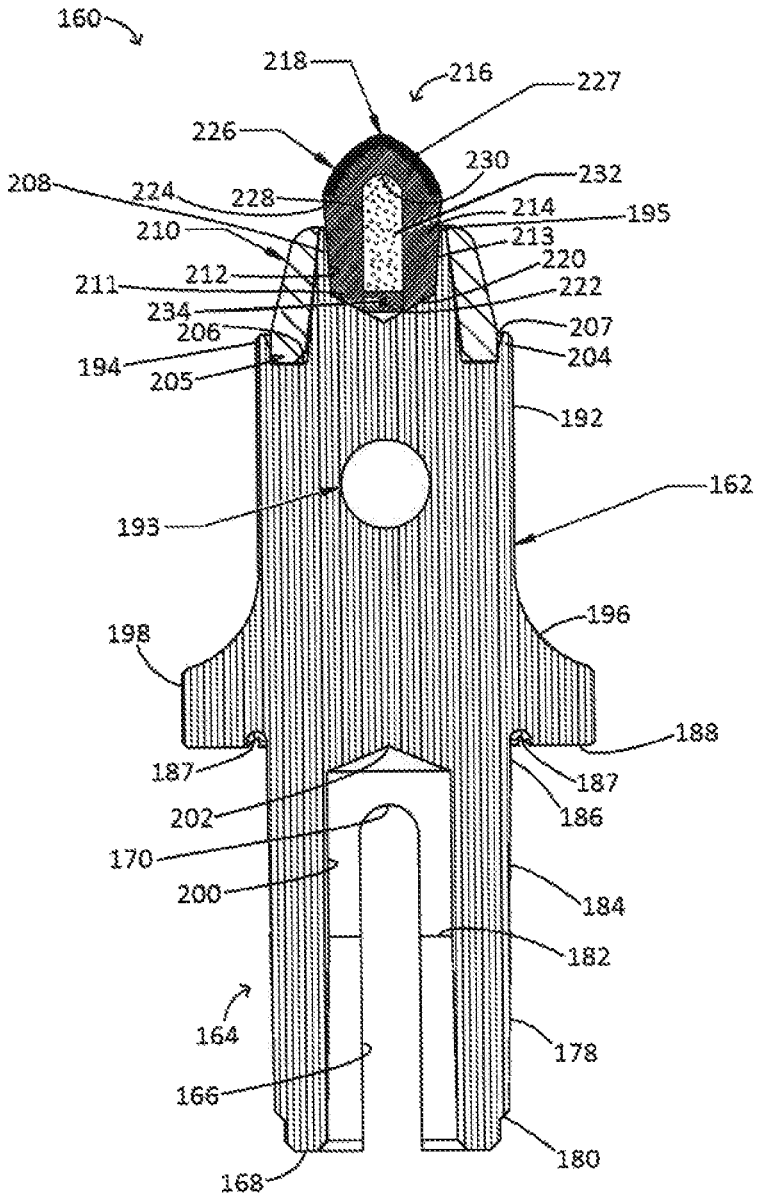
FIG. 11 is a cross-section view of a fourth embodiment of a bit/holder and a fifth embodiment of a tip insert in accordance with implementations of this disclosure.
Figure 12:
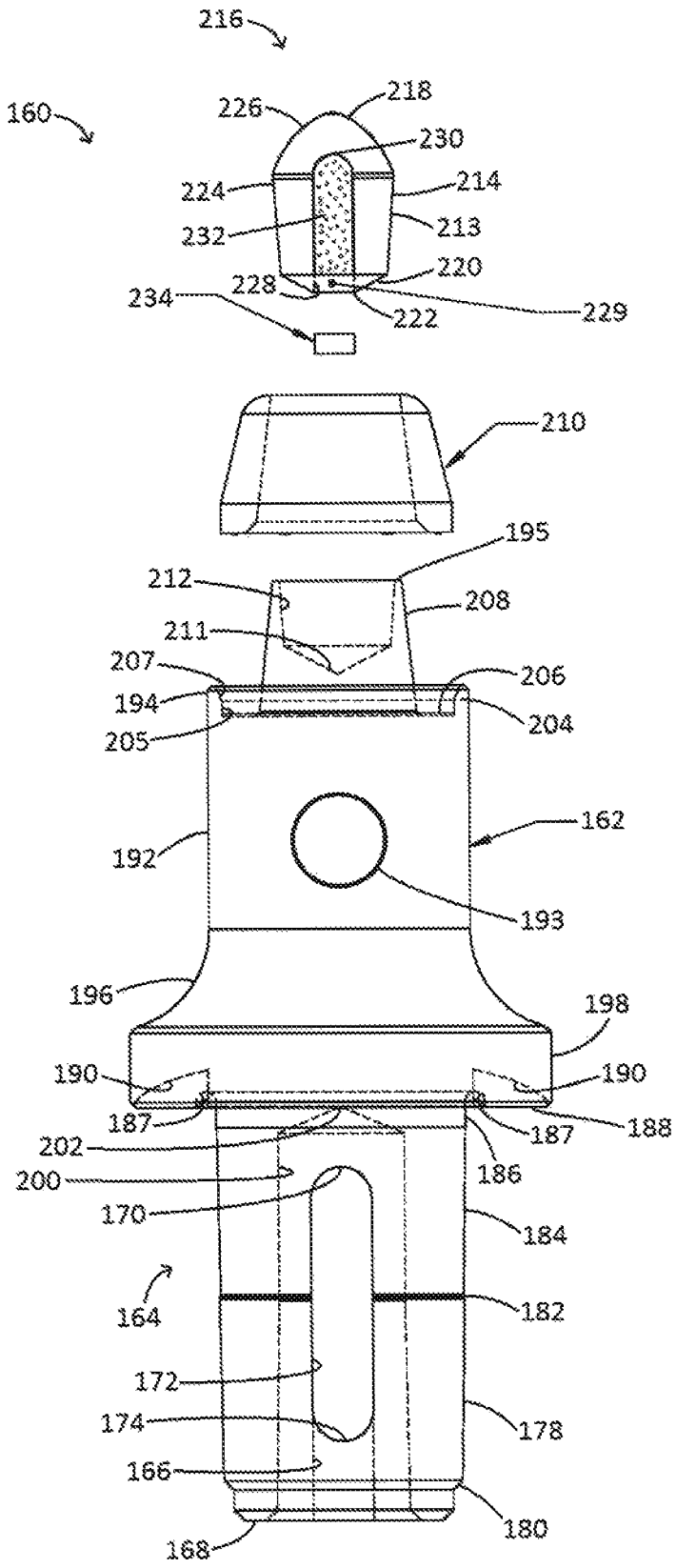
FIG. 12 is an exploded side elevation view of the fourth embodiment of a bit/holder and the fifth embodiment of the tip insert in accordance with implementations of this disclosure.

Referring to FIGS. 11 and 12, a fifth embodiment of a generally conical tip insert 216, that includes a parabolic curved section below an apex of the tip insert 216, in a fourth embodiment of a bit/holder 160 of the present disclosure is shown. The bit/holder 160 is a unitary bit and bit holder construction that includes a body 162 and a generally cylindrical hollow shank 164 axially depending from a bottom of the body 162. The shank 164 includes an elongate first slot 166 extending from a generally annular distal end 168 of the shank 164 axially upward or forward to an upper termination 170 adjacent the upper or forward end of the shank 164. In this embodiment, the shank 164 also includes an internally oriented second slot 172 (FIG. 12) located approximately 180 degrees around the annular shank 164 from the first slot 166. This second slot 172 is parallel to the first slot 166 and is an internal slot having a rearward semicircular termination 174 (FIG. 12) inwardly adjacent to the distal end 168 of the shank 164 and a forward semicircular termination 176 (not shown) generally coinciding longitudinally and axially with the upper termination 170 of the first slot 166.

In this illustrated embodiment, the shank 164 includes a lower or first tapered portion 178 running axially from a stepped shoulder 180 adjacent the distal end 168 of the shank 164. The stepped shoulder 180 is disposed between the lower tapered portion 178 and the distal end 168. A diameter of the stepped shoulder 180 increases, or steps up, as it axially extends from the distal end 168 to the lower tapered portion 178. The first tapered portion 178 runs upwardly or axially from the stepped shoulder 180 of the shank 164 and terminates generally mid slot 166 longitudinally. The shank 164 also includes an annular shoulder 182 separating the lower tapered portion 178 from an upper or second tapered portion 184 which extends from the shoulder 182 to generally adjacent to the top of the shank 164 or forward terminations 170, 176 of slots 166, 172, respectively. The annular shoulder 182 is disposed between the lower tapered portion 178 and the upper tapered portion 184. A diameter of the annular shoulder 182 decreases, or steps down, as it axially extends from the lower tapered portion 178 to the upper tapered portion 184. A generally cylindrical top portion 186 of the shank 164 extends from a position adjacent the top or upper terminations 170, 176 of slots 166, 172, respectively, towards a generally annular back flange 188 that denotes the base or bottom of the body 162 of the bit/holder 160. The top of the shank 164 may include a rounded junction 187 between the top portion 186 of the shank 164 and the generally annular flange 188 of the body 162 of the bit/holder 160, which is provided to avoid sharp corners which may provide an area for stress cracks to begin.

The generally annular flange 188 includes a pair of horizontal slots 190-190 (FIG. 12) generally perpendicular to the longitudinal axis of the combination bit/bit holder, one on either side of the generally annular flange 188. The horizontal slots 190-190 are configured to receive a pair of bifurcated fork tines that may be inserted between the base of the body 162 of the bit/holder 160 and a base block (not shown) into which the shank 164 of the bit/holder combination is inserted and retained by outward radial force in use.

A central bore 200 longitudinally and axially extending through the shank 164 of the bit/holder 160 combination terminates at bore termination 202, which in this illustrated embodiment has a conical shape, that is approximately at the upper end of the shank 164. This allows the generally C-shaped annular side wall of the shank 164 to radially contract when the shank 164 is mounted in a tapered or cylindrical bore in a base block (not shown).

In this fourth illustrated embodiment of the bit/holder 160, the bit holder body 162 includes a generally cylindrical or annular upper body portion 192 depending from a forward end 194 of the upper body portion 192. Optionally, a mid-section of the upper body portion 192 of the bit/holder 160 may include a cross or through hole 193 substantially perpendicular to the longitudinal axis of the bit/holder 160. This cross hole 193 extends horizontally through the upper body portion 192 and forms a receiver for a drift pin (not shown) used in connection with the cup portion of a bit/holder insertion tool. In an alternate embodiment, the upper body portion 192 of the bit/holder 160 may not include a cross or through hole. A mediate body portion 196 subjacent the upper body portion 192 generally slopes axially and radially outwardly to a radially extending generally cylindrical tire portion 198.

The bit holder body 162, in order to provide superior brazing of a tungsten carbide ring 210 to the forward end 194 of the upper body portion 192, includes a forwardly extending annular collar 204 that is created on the bit holder body 162 to provide an annular trough 206 around a tapered forward extension 208 of the bit holder body 162 onto which the annular ring 210 is mounted. In this illustrated embodiment, the annular collar 204 includes a cylindrical bottom inner wall 205 and a tapered top inner wall or countersink 207. The vertical outer wall of the collar 104 will keep brazing material from flowing outwardly of the joinder between the base of the ring 210 and the annular trough 206 on which the ring 210 is positioned. The annular trough 206 is therearound positioned perpendicular to the axis of the bit/holder 160 from the interior of which axially extends the smaller radially oriented annular tapered upper or forward extension 208. Around this tapered forward extension 208 is fitted the annular tungsten carbide ring 210, seated in the annular trough 206, which may be brazed into unitary construction with the remainder of the bit/holder 160. The top or forwardmost portion of the tungsten carbide ring 210 and the annular tapered forward extension 208 of the upper body portion terminate generally at a forward end 195 of the bit holder body 162 of the combination bit/holder 160.

With the bit holder body 162 of the present disclosure in this embodiment made of 4340 or equivalent steel, the top of the forward extension 208 of the bit holder body 162 includes a radially declining tapered bore 212, or a generally cylindrical bore in other embodiments, extending from the co-terminal upper wall of the body axially inwardly thereof which defines, in this illustrated embodiment, a radially declining taper. In other embodiments, the bore can also have a hollow generally cylindrical shape or a slight draw or draft angle. The bore 212 extends a short distance longitudinally axially inwardly of the forward extension 208 to define a base 211 for the tip insert base 214. The base 211, in this illustrated embodiment, has a conical shape.

The tapered bore 212 provides a space for receiving a complementary shaped declining tapered outer surface 213 of the base 214 of the tip insert 216 for the bit/holder combination. In one exemplary implementation of the fifth embodiment, the tip insert 216 can have a diameter in the range of ⅝ inch to 1¼ inch. In this fifth embodiment, the base 214 includes a tapered portion 220 adjacent a distal end 222 of the base 214. The base 214 may be made of steel or tungsten carbide and includes a tip 218 at an outer or forward end 224 of the base 214. The tip 218 can have a frustoconical shape, a flat generally cylindrical puck shape, a parabolic ballistic shape, and/or an arcuate shape. In this illustrated embodiment, the tip insert 216, comprising the base 214 and the tip 218, goes through a sinter-HIP process that comprises a vacuum sinter with a post hot isostatic pressure (HIP) operation where the carbide of the tip insert 216 is first heated in a vacuum furnace at vacuum. At the end of the first vacuum sinter process, the vacuum is replaced by pressurized argon gas of many atmospheres, such as 10,000-40,000 PSI, which creates a sealed envelope of molten binder metals, such as cobalt, around the carbide.

In this embodiment, an overlay 227 (FIG. 11) of a polycrystalline diamond structure is applied to an outer surface or forward end 226 of tip 218. The overlay 227 may also be made of an industrial diamond material and may be a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature process (HPHT). The sinter-HIP tip insert 216, which includes the tip 218 and the base 214, and the overlay 227 on the forward end 226 of the tip 218 are centered and placed in a can or metal enclosure and a plurality of hydraulic pistons apply pressure and force on the can over time during the HPHT process, compressing and/or pressing the tip 218 and base 214 again. The HPHT process liquefies the binder material, such as cobalt in this embodiment, which migrates toward the overlay 227 and binds to the diamond and tungsten carbide producing a stronger form. The diamond to diamond bond in the overlay 227 and tip 218 is created by the catalytic attachment of the cobalt within the small cavities of diamond crystals in the overlay 227. The overlay 227 occupies a large radial and axial profile of the tip 218 which allows faster heat transfer into a region subjacent to the overlay 227 PCD layer. Excessively high heat, such as temperatures above 1300 degrees F., is the greatest cause of PCD failure due to diamond connective failure, the quick heat transfer from the tip 218 of the PCD cutting zone, which is approximately ½ inch depth of cut per tip engagement, to the subjacent region below the PCD drastically reduces the possibility of a temperature of the tip 218 of the PCD reaching temperatures at or above 1300 degrees F. for any extended period of time thereby avoiding failure of the PCD layer.

The tip insert 216 further includes a bore 228 that axially extends from the distal end 222 of the tip insert 216 to a bore termination 230, which in this illustrated embodiment has a rounded shape and is located within the tip 218 adjacent an apex thereof. In other embodiments, the bore termination 230 may have various other shapes, such as a conical shape and a frustoconical shape, and may be located within the base 214 and/or adjacent the tip 218. The bore 228, in this embodiment, is formed by a wire-cut electrical discharge machining (EDM) process that removes material from the tip insert 216 by a series of rapidly recurrent discharges between two electrodes separated by a dielectric liquid and subject to an electric voltage. In an exemplary implementation of the fifth embodiment, the bore 228 can have a diameter of approximately 3/32 inch. The bore 228 is adapted to receive diamond particles 232 that may be brazed, packed firmly, bonded with epoxy, or the like, into the bore 228 and distribute heat generated at the cutting tip 118. The diamond particles 232 are sealed within bore 228 by a metal plug 234 that is placed in a space 229 (FIG. 12) within bore 228 adjacent the distal end 222 of the base 214.

Figure 13:
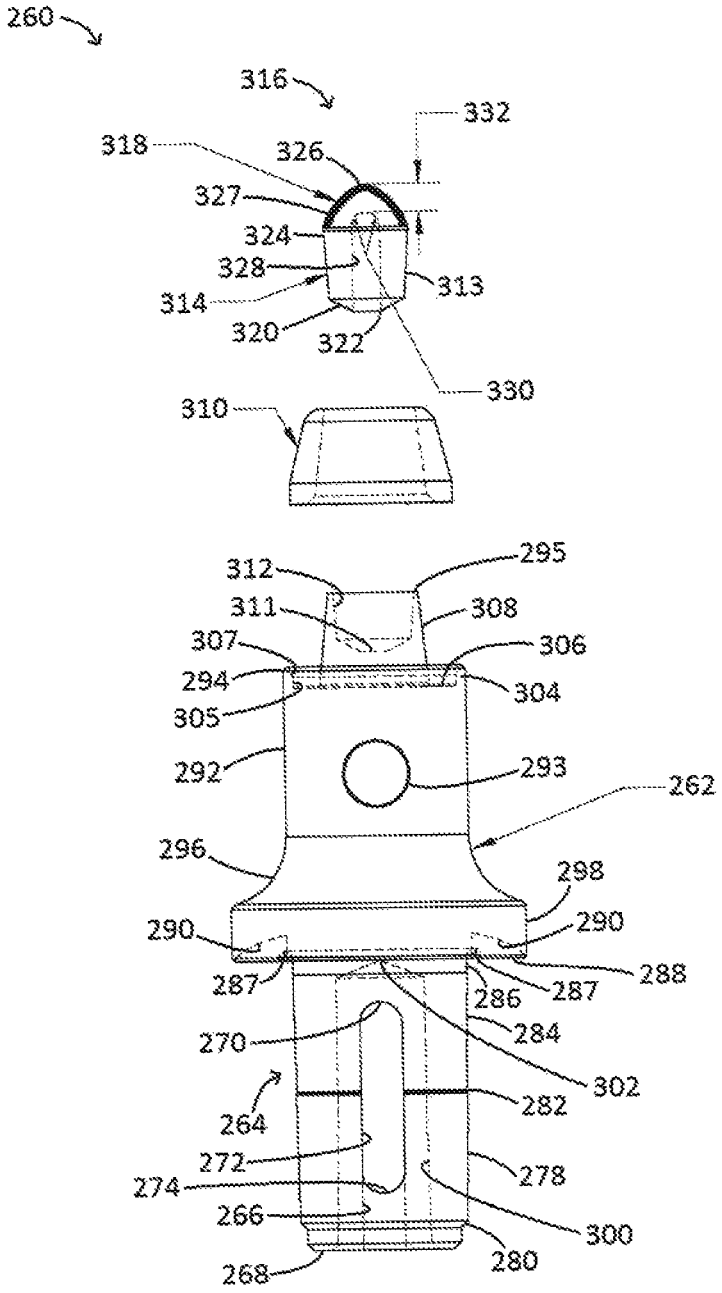
FIG. 13 is an exploded side elevation view of a fifth embodiment of a bit/holder and a sixth embodiment of a tip insert in accordance with implementations of this disclosure.

Referring to FIG. 13, a sixth embodiment of a generally conical tip insert 316, that includes a parabolic curved section below an apex of the tip insert 316, in a fifth embodiment of a bit/holder 260 of the present disclosure is shown. The bit/holder 260 is a unitary bit and bit holder construction that includes a body 262 and a generally cylindrical hollow shank 264 axially depending from a bottom of the body 262. The shank 264 includes an elongate first slot 266 extending from a generally annular distal end 268 of the shank 264 axially upward or forward to an upper termination 270 adjacent the upper or forward end of the shank 264. In this embodiment, the shank 264 also includes an internally oriented second slot 272 located approximately 180 degrees around the annular shank 264 from the first slot 266. This second slot 272 is parallel to the first slot 266 and is an internal slot having a rearward semicircular termination 274 inwardly adjacent to the distal end 268 of the shank 264 and a forward semicircular termination 276 (not shown) generally coinciding longitudinally and axially with the upper termination 270 of the first slot 266.

In this illustrated embodiment, the shank 264 includes a lower or first tapered portion 278 running axially from a stepped shoulder 280 adjacent the distal end 268 of the shank 264. The stepped shoulder 280 is disposed between the lower tapered portion 278 and the distal end 268. A diameter of the stepped shoulder 280 increases, or steps up, as it axially extends from the distal end 268 to the lower tapered portion 278. The first tapered portion 278 runs upwardly or axially from the stepped shoulder 280 of the shank 264 and terminates generally mid slot 266 longitudinally. The shank 264 also includes an annular shoulder 282 separating the lower tapered portion 278 from an upper or second tapered portion 284 which extends from the shoulder 282 to generally adjacent to the top of the shank 264 or forward terminations 270, 276 of slots 266, 272, respectively. The annular shoulder 282 is disposed between the lower tapered portion 278 and the upper tapered portion 284. A diameter of the annular shoulder 282 decreases, or steps down, as it axially extends from the lower tapered portion 278 to the upper tapered portion 284. A generally cylindrical top portion 286 of the shank 264 extends from a position adjacent the top or upper terminations 270, 276 of slots 266, 272, respectively, towards a generally annular back flange 288 that denotes the base or bottom of the body 262 of the bit/holder 260. The top of the shank 264 may include a rounded junction 287 between the top portion 286 of the shank 264 and the generally annular flange 288 of the body 262 of the bit/holder 260, which is provided to avoid sharp corners which may provide an area for stress cracks to begin.

The generally annular flange 288 includes a pair of horizontal slots 290-290 generally perpendicular to the longitudinal axis of the combination bit/bit holder, one on either side of the generally annular flange 288. The horizontal slots 290-290 are configured to receive a pair of bifurcated fork tines that may be inserted between the base of the body 262 of the bit/holder 260 and a base block (not shown) into which the shank 264 of the bit/holder combination is inserted and retained by outward radial force in use.

A central bore 300 longitudinally and axially extending through the shank 264 of the bit/holder 260 combination terminates at bore termination 302, which in this illustrated embodiment has a conical shape, which is approximately at the upper end of the shank 264. This allows the generally C-shaped annular side wall of the shank 264 to radially contract when the shank 264 is mounted in a tapered or cylindrical bore in a base block (not shown).

In this fifth illustrated embodiment of the bit/holder 260, the bit holder body 262 includes a generally cylindrical or annular upper body portion 292 depending from a forward end 294 of the upper body portion 292. Optionally, a mid-section of the upper body portion 292 of the bit/holder 260 may include a cross or through hole 293 substantially perpendicular to the longitudinal axis of the bit/holder 260. This cross hole 293 extends horizontally through the upper body portion 292 and forms a receiver for a drift pin (not shown) used in connection with the cup portion of a bit/holder insertion tool. In an alternate embodiment, the upper body portion 292 of the bit/holder 260 may not include a cross or through hole. A mediate body portion 296 subjacent the upper body portion 292 generally slopes axially and radially outwardly to a radially extending generally cylindrical tire portion 298.

The bit holder body 262, in order to provide superior brazing of a tungsten carbide ring 310 to the forward end 294 of the upper body portion 292, includes a forwardly extending annular collar 304 that is created on the bit holder body 262 to provide an annular trough 306 around a tapered forward extension 308 of the bit holder body 262 onto which the annular ring 310 is mounted. In this illustrated embodiment, the annular collar 304 includes a cylindrical bottom inner wall 305 and a tapered top inner wall or countersink 307. The vertical outer wall of the collar 304 will keep brazing material from flowing outwardly of the joinder between the base of the ring 310 and the annular trough 306 on which the ring 310 is positioned. The annular trough 306 is therearound positioned perpendicular to the axis of the bit/holder 260 from the interior of which axially extends the smaller radially oriented annular tapered upper or forward extension 308. Around this tapered forward extension 308 is fitted the annular tungsten carbide ring 310, seated in the annular trough 306, which may be brazed into unitary construction with the remainder of the bit/holder 260. The top or forwardmost portion of the tungsten carbide ring 310 and the annular tapered forward extension 308 of the upper body portion terminate generally at a forward end 295 of the bit holder body 262 of the combination bit/holder 260.

With the bit holder body 262 of the present disclosure in this embodiment made of 4340 or equivalent steel, the top of the forward extension 308 of the bit holder body 262 includes a radially declining tapered bore 312, or a generally cylindrical bore in other embodiments, extending from the co-terminal upper wall of the body axially inwardly thereof which defines, in this illustrated embodiment, a radially declining taper. In other embodiments, the bore can also have a hollow generally cylindrical shape or a slight draw or draft angle. The bore 312 extends a short distance longitudinally axially inwardly of the forward extension 308 to define a base 311 for the tip insert base 314. The base 311, in this illustrated embodiment, has a frustoconical shape.

The tapered bore 312 provides a space for receiving a complementary shaped declining tapered outer surface 313 of the base 314 of the tip insert 316 for the bit/holder combination. In one exemplary implementation of the sixth embodiment, the tip insert 316 can have a diameter in the range of ⅝ inch to 1¼ inch. In this sixth embodiment, the base 314 includes a tapered portion 320 adjacent a distal end 322 of the base 314. The base 314 may be made of steel or tungsten carbide and includes a tip 318 at an outer or forward end 324 of the base 314. The tip 318 can have a frustoconical shape, a flat generally cylindrical puck shape, a parabolic ballistic shape, and/or an arcuate shape. In this illustrated embodiment, the tip insert 316, comprising the base 314 and the tip 318, goes through a sinter-HIP process that comprises a vacuum sinter with a post hot isostatic pressure (HIP) operation where the carbide of the tip insert 316 is first heated in a vacuum furnace at vacuum. At the end of the first vacuum sinter process, the vacuum is replaced by pressurized argon gas of many atmospheres, such as 10,000-40,000 PSI, which creates a sealed envelope of molten binder metals, such as cobalt, around the carbide.

In this embodiment, an overlay 327 of a polycrystalline diamond structure is applied to an outer surface or forward end 326 of tip 318. The overlay 327 may also be made of an industrial diamond material and may be a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature process (HPHT). The sinter-HIP tip insert 316, which includes the tip 318 and the base 314, and the overlay 327 on the forward end 326 of the tip 318 are centered and placed in a can or metal enclosure and a plurality of hydraulic pistons apply pressure and force on the can over time during the HPHT process, compressing and/or pressing the tip 318 and base 314 again. The HPHT process liquefies the binder material, such as cobalt in this embodiment, which migrates toward the overlay 327 and binds to the diamond and tungsten carbide producing a stronger form. The diamond to diamond bond in the overlay 327 and tip 318 is created by the catalytic attachment of the cobalt within the small cavities of diamond crystals in the overlay 327. The overlay 327 occupies a large radial and axial profile of the tip 318 which allows faster heat transfer into a region subjacent to the overlay 327 PCD layer. Excessively high heat, such as temperatures above 1300 degrees F., is the greatest cause of PCD failure due to diamond connective failure, the quick heat transfer from the tip 318 of the PCD cutting zone, which is approximately ½ inch depth of cut per tip engagement, to the subjacent region below the PCD drastically reduces the possibility of a temperature of the tip 318 of the PCD reaching temperatures at or above 1300 degrees F. for any extended period of time thereby avoiding failure of the PCD layer.

The tip insert 316 further includes a bore 328 that axially extends from the distal end 322 of the tip insert 316 to a bore termination 330, which in this illustrated embodiment, has a rounded shape and is located within the tip 318 adjacent an apex thereof. In other embodiments, the bore termination 330 may have various other shapes, such as a conical shape and a frustoconical shape, and may be located within the base 314 and/or adjacent the tip 318. The bore 328, in this embodiment, is formed by a wire-cut electrical discharge machining (EDM) process that removes material from the tip insert 316 by a series of rapidly recurrent discharges between two electrodes separated by a dielectric liquid and subject to an electric voltage. In an exemplary implementation of the sixth embodiment, the bore 328 can have a diameter of approximately 3/32 inch. In this illustrated embodiment, the bore termination 330 is approximately a minimum distance 332, which may be approximately 3/16 inch, from the apex of the tip 318. The bore 328 is adapted to allow for inward contraction and/or movement when the overlay 327 distributes heat generated at the cutting tip 318 and transfers the heat into the base 314 during cutting operations. The bore 328 prevents less outward expansion of the tungsten carbide portion of the tip insert 316, such as the base 314 and the tip 318 subjacent the overlay 327, in the direction of the overlay 327 and thereby prevents the expanded tungsten carbide from fracturing the overlay 327 of the tip insert 316.

Figure 14:
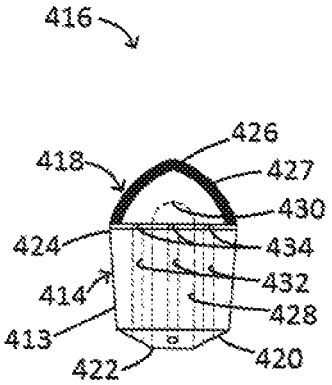
FIG. 14 is side elevation view of a seventh embodiment of a tip insert in accordance with implementations of this disclosure.
Figure 15:
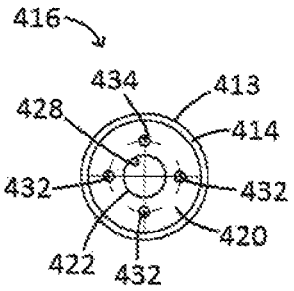
FIG. 15 is a bottom elevation view of the seventh embodiment of the tip insert in accordance with implementations of this disclosure.
Figure 16:
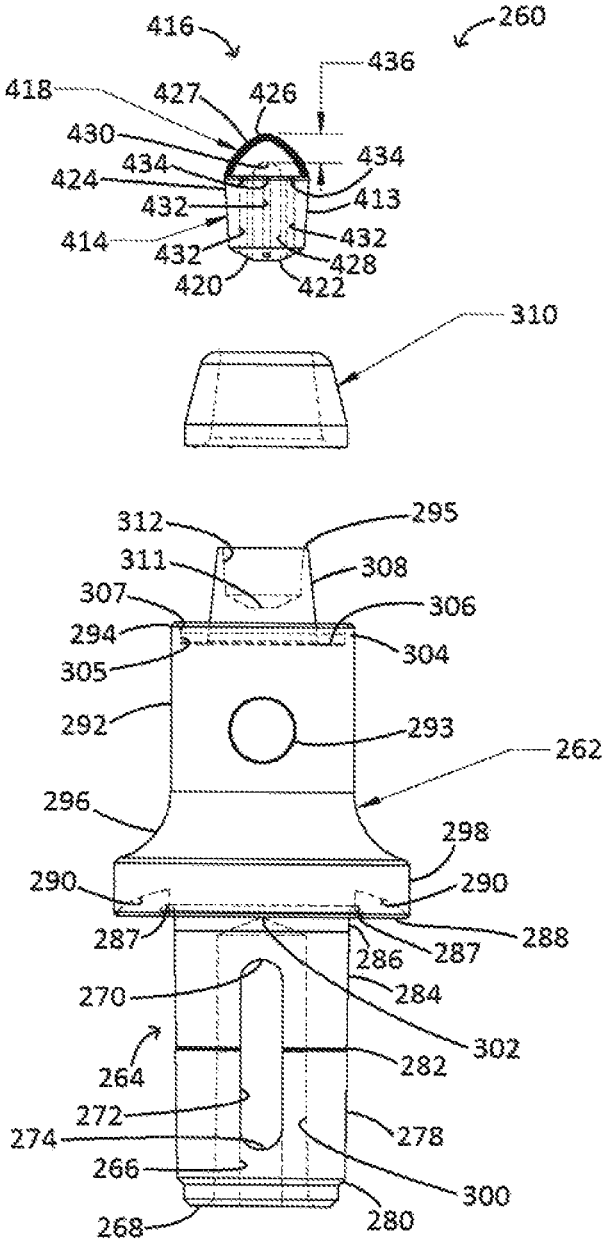
FIG. 16 is an exploded side elevation view of the fifth embodiment of the bit/holder and the seventh embodiment of the tip insert in accordance with implementations of this disclosure.
Figure 17:
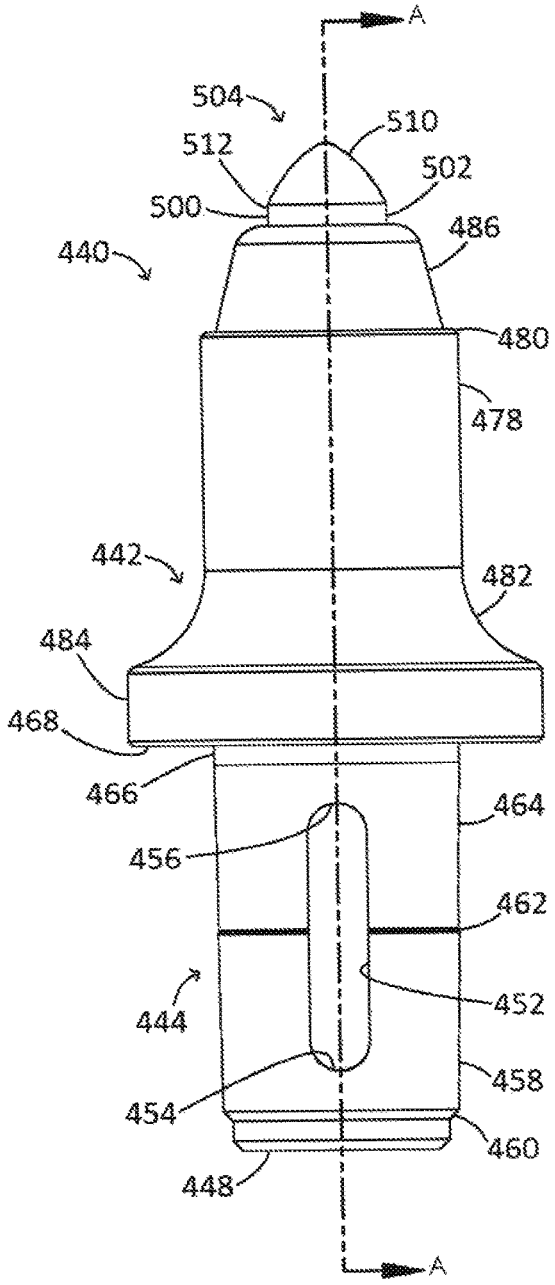
FIG. 17 is a side elevation view of a sixth embodiment of a bit/holder and an eighth embodiment of a tip insert in accordance with implementations of this disclosure.
Figure 18:
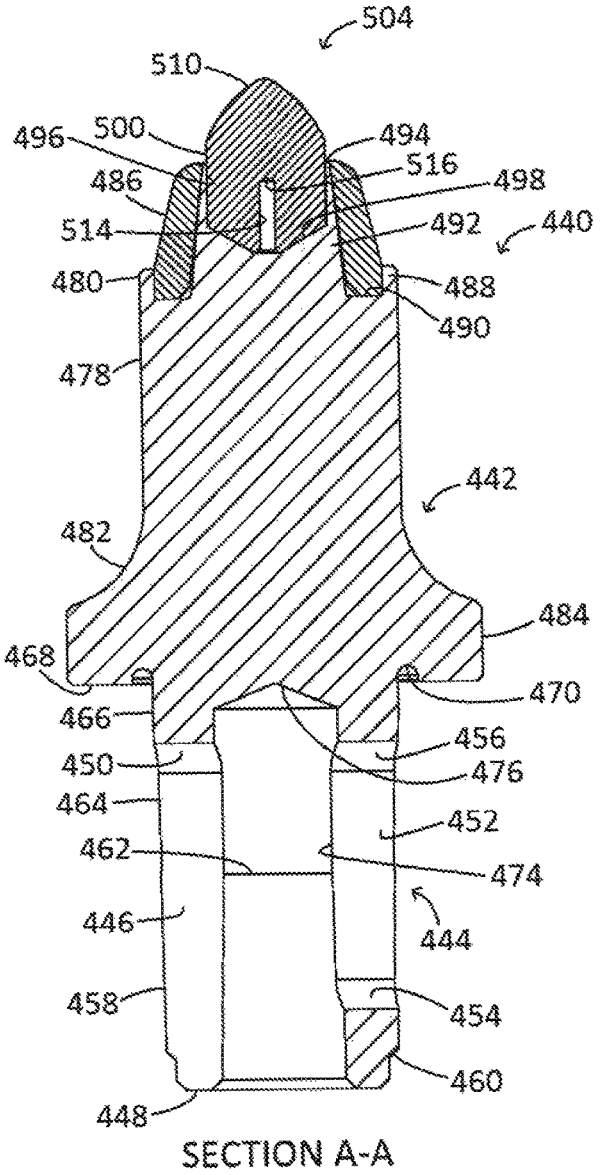
FIG. 18 is a cross-sectional view taken along line A-A of FIG. 17 of the sixth embodiment of the bit/holder and the eighth embodiment of the tip insert in accordance with implementations of this disclosure.

Referring to FIGS. 14-16, a seventh embodiment of a generally conical tip insert 416, that includes a parabolic curved section below an apex of the tip insert 416, and the fifth embodiment of a bit/holder 260, as described with respect to FIG. 13 above, of the present disclosure is shown. The tip insert 416 comprises a generally conical tip 418 at a forward end 424 of a tip insert base 414. In one exemplary implementation of the seventh embodiment, the tip insert 416 can have a diameter in the range of ⅝ inch to 1¼ inch. The base 414 comprises a complementary shaped declining tapered outer surface 413 that is adapted to be mounted in the tapered bore 312 of the bit/holder 260. In this seventh embodiment, the base 414 includes a tapered portion 420 adjacent a distal end 422 of the base 414. The base 414 may be made of steel or tungsten carbide and includes a tip 418 at an outer or forward end 424 of the base 414. The tip 418 can have a frustoconical shape, a flat generally cylindrical puck shape, a parabolic ballistic shape, and/or an arcuate shape. In this illustrated embodiment, the tip insert 416, comprising the base 414 and the tip 418, goes through a sinter-HIP process that comprises a vacuum sinter with a post hot isostatic pressure (HIP) operation where the carbide of the tip insert 416 is first heated in a vacuum furnace at vacuum. At the end of the first vacuum sinter process, the vacuum is replaced by pressurized argon gas of many atmospheres, such as 10,000-40,000 PSI, which creates a sealed envelope of molten binder metals, such as cobalt, around the carbide.

In this embodiment, an overlay 427 of a polycrystalline diamond structure is applied to an outer surface or forward end 426 of tip 418. The outer surface 426 of the tip 418 may also include an overlay 427 of an industrial diamond material and may be a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature process (HPHT). The sinter-HIP tip insert 416, which includes the tip 418 and the base 414, and the overlay 427 on the forward end 426 of the tip 418 are centered and placed in a can or metal enclosure and a plurality of hydraulic pistons apply pressure and force on the can over time during the HPHT process, compressing and/or pressing the tip 418 and base 414 again. The HPHT process liquefies the binder material, such as cobalt in this embodiment, which migrates toward the overlay 427 and binds to the diamond and tungsten carbide producing a stronger form. The diamond to diamond bond in the overlay 427 and tip 418 is created by the catalytic attachment of the cobalt within the small cavities of diamond crystals in the overlay 427. The overlay 427 occupies a large radial and axial profile of the tip 418 which allows faster heat transfer into a region subjacent to the overlay 427 PCD layer. Excessively high heat, such as temperatures above 1300 degrees F., is the greatest cause of PCD failure due to diamond connective failure, the quick heat transfer from the tip 418 of the PCD cutting zone, which is approximately ½ inch depth of cut per tip engagement, to the subjacent region below the PCD drastically reduces the possibility of a temperature of the tip 418 of the PCD reaching temperatures at or above 1300 degrees F. for any extended period of time thereby avoiding failure of the PCD layer.

The tip insert 416 comprises a bore 428 that axially extends from the distal end 422, shown in FIG. 15, of the tip insert 416 to a bore termination 430, which in this illustrated embodiment, has a rounded shape and is located within the tip 418 adjacent an apex thereof. In this illustrated embodiment, the bore termination 430 is approximately a minimum distance 436 (FIG. 16), which may be approximately ¼ inch, from the apex of the tip 418. In other embodiments, the bore termination 430 may have various other shapes, such as a conical shape and a frustoconical shape, and may be located within the base 414 and/or adjacent the tip 418. The tip insert 416 further comprises at least one bore 432, each bore 432 extending from the tapered portion 420 of the tip insert 416 to a bore termination 434, which in this illustrated embodiment, has a rounded shape and is located within the tip insert 416 subjacent the tip 418. In other embodiments, the bore terminations 434 may have various other shapes, such as a conical shape and a frustoconical shape, and may be located within the base 414, adjacent the tip 418, and/or within the tip 418 adjacent an apex thereof. In this illustrated embodiment, bores 432 are radially positioned from bore 428 as shown in FIG. 15. Bore 428 and bores 432, in this embodiment, are formed by a wire-cut electrical discharge machining (EDM) process that removes material from the tip insert 416 by a series of rapidly recurrent discharges between two electrodes separated by a dielectric liquid and subject to an electric voltage. In an exemplary implementation of the seventh embodiment, the bore 428 can have a diameter of approximately 3/32 inch and the bores 432 can have diameter of less than 3/32 inch. Bore 428 and bores 432 are adapted to allow for inward contraction and/or movement when the overlay 427 distributes heat generated at the cutting tip 418 and transfers the heat into the base 414 during cutting operations. Bore 428 and bores 432 prevent less outward expansion of the tungsten carbide portion of the tip insert 416, such as the base 414 and the tip 418 subjacent the overlay 427, in the direction of the overlay 427 and thereby prevents the expanded tungsten carbide from fracturing the overlay 427 of the tip insert 416.

Referring to FIGS. 17-20, an eighth embodiment of a generally conical tip insert 504, that includes a parabolic curved section below an apex of the tip insert 504, in a sixth embodiment of a bit/holder 440 of the present disclosure is shown. The bit/holder 440 is a unitary bit and bit holder construction that includes a body 442 and a generally cylindrical hollow shank 444 axially depending from a bottom of the body 442. The shank 444 includes an elongate first slot 446 (FIGS. 18 and 20) extending from a generally annular distal end 448 of the shank 444 axially upward or forward to an upper termination 450 (FIG. 18) adjacent the upper or forward end of the shank 444. In this embodiment, the shank 444 also includes an internally oriented second slot 452 located approximately 180 degrees around the annular shank 444 from the first slot 446. This second slot 452 is parallel to the first slot 446 and is an internal slot having a rearward semicircular termination 454 inwardly adjacent to the distal end 448 of the shank 444 and a forward semicircular termination 456 generally coinciding longitudinally and axially with the upper termination 450 of the first slot 446.

In this illustrated embodiment, the shank 444 includes a lower or first tapered portion 458 running axially from a stepped shoulder 460 adjacent the distal end 448 of the shank 444. The stepped shoulder 460 is disposed between the lower tapered portion 458 and the distal end 448. A diameter of the stepped shoulder 460 increases, or steps up, as it axially extends from adjacent the distal end 448 to the lower tapered portion 458. The first tapered portion 458 runs upwardly or axially from the stepped shoulder 460 of the shank 444 and terminates generally mid slot 446 longitudinally. The shank 444 also includes an annular shoulder 462 separating the lower tapered portion 458 from an upper or second tapered portion 464 which extends from the shoulder 462 to generally adjacent to the top of the shank 444 or forward terminations 450, 456 of slots 446, 452, respectively. The annular shoulder 462 is disposed between the lower tapered portion 458 and the upper tapered portion 464. A diameter of the annular shoulder 462 decreases, or steps down, as it axially extends from the lower tapered portion 458 to the upper tapered portion 464. A generally cylindrical top portion 466 of the shank 444 extends from a position adjacent the top or upper terminations 450, 456 of slots 446, 452, respectively, towards a generally annular back flange 468 that denotes the base or bottom of the body 442 of the bit/holder 440. The top of the shank 444 may include a rounded junction 470 (FIG. 18) between the top portion 466 of the shank 444 and the generally annular flange 468 of the body 442 of the bit/holder 440, which is provided to avoid sharp corners which may provide an area for stress cracks to begin.

The generally annular flange 468 includes a pair of horizontal slots 472-472 (FIG. 20) generally perpendicular to the longitudinal axis of the combination bit/bit holder, one on either side of the generally annular flange 468. The horizontal slots 472-472 are configured to receive a pair of bifurcated fork tines that may be inserted between the base of the body 442 of the bit/holder 440 and a base block (not shown) into which the shank 444 of the bit/holder combination is inserted and retained by outward radial force in use.

A central bore 474 (FIG. 18) longitudinally and axially extending through the shank 444 of the bit/holder 440 combination terminates at bore termination 476 (FIG. 18), which in this illustrated embodiment has a conical shape, that is approximately at the upper end of the shank 444. This allows the generally C-shaped annular side wall of the shank 444 to radially contract when the shank 444 is mounted in a tapered or cylindrical bore in a base block (not shown).

In this sixth illustrated embodiment of the bit/holder 440, the bit holder body 442 includes a generally cylindrical or annular upper body portion 478 depending from a forward end 480 of the upper body portion 478. A mediate body portion 482 subjacent the upper body portion 478 generally slopes axially and radially outwardly to a radially extending generally cylindrical tire portion 484. In this illustrated embodiment, the upper body portion 478 does not include a cross or through hole. Optionally, in alternate embodiments, a mid-section of the upper body portion of the bit/holder may include a cross or through hole substantially perpendicular to the longitudinal axis of the bit/holder. This cross or through hole extends horizontally through the upper body portion and forms a receiver for a drift pin (not shown) used in connection with the cup portion of a bit/holder insertion tool.

The bit holder body 442, in order to provide superior brazing of a tungsten carbide ring 486 to the forward end 480 of the upper body portion 478, includes a forwardly extending annular collar 488 that is created on the bit holder body 442 to provide an annular trough 490 (FIG. 18) around a tapered forward extension 492 (FIGS. 18 and 19) of the bit holder body 442 onto which the annular ring 486 is mounted. The vertical outer wall of the collar 488 will keep brazing material from flowing outwardly of the joinder between the base of the ring 486 and the annular trough 490 on which the ring is positioned. The annular trough 490 is therearound positioned perpendicular to the axis of the bit/holder 440 from the interior of which axially extends the smaller radially oriented annular tapered upper or forward extension 492. Around this tapered forward extension 492 is fitted the annular tungsten carbide ring 486, seated in the annular trough 490, which may be brazed into unitary construction with the remainder of the bit/holder 440. The top or forwardmost portion of the tungsten carbide ring 486 and the annular tapered forward extension 492 of the upper body portion terminate generally at a forward end 494 (FIGS. 18 and 19) of the bit holder body 442 of the combination bit/holder 440.

With the bit holder body 442 of the present disclosure in this embodiment made of 4340 or equivalent steel, the top of the forward extension 492 of the bit holder body 442 includes a generally cylindrical bore 496 (FIG. 18), or a radially declining tapered bore in other embodiments, extending from the co-terminal upper wall of the body axially inwardly thereof which defines, in this illustrated embodiment, a generally cylindrical shape. In other embodiments, the bore can also have a radially declining taper or a slight draw or draft angle. The bore 496 extends a short distance longitudinally axially inwardly of the forward extension 492 to define a base 498 (FIG. 18) for a base 500 of the tip insert 504. The base 498, in this illustrated embodiment, has a frustoconical shape.

Figure 19:
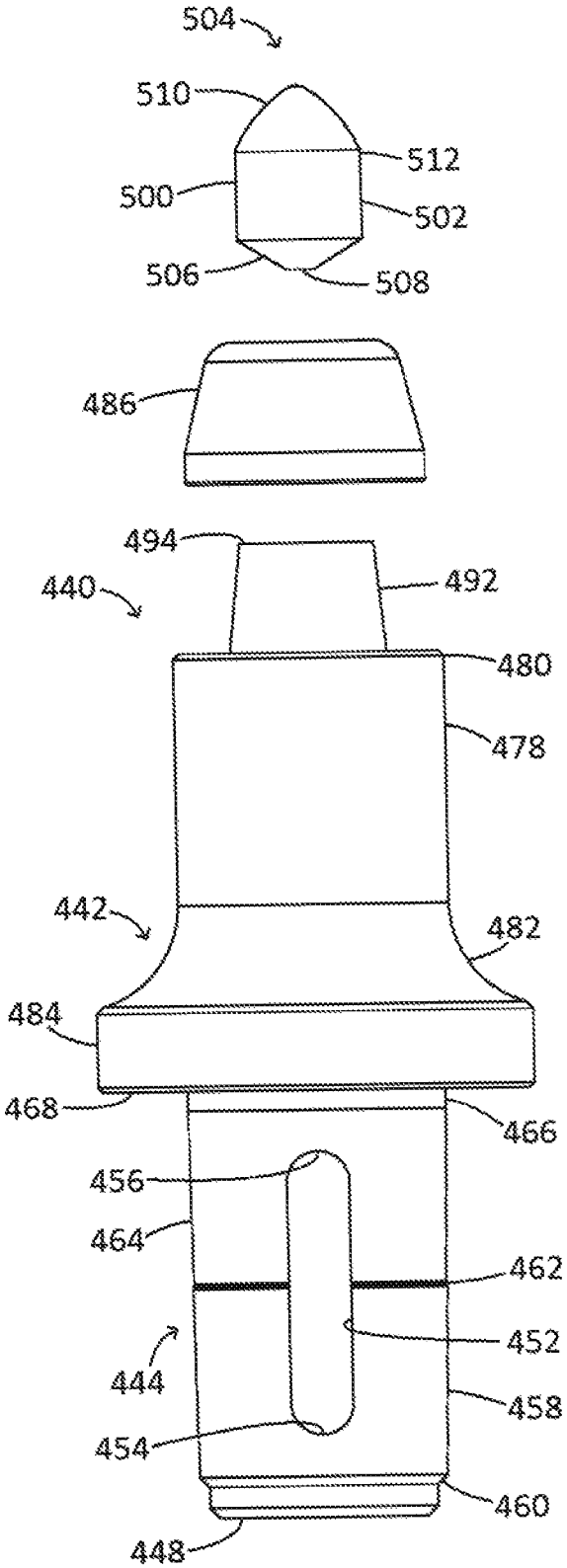
FIG. 19 is an exploded side elevation view of the sixth embodiment of the bit/holder and the eighth embodiment of the tip insert in accordance with implementations of this disclosure.
Figure 20:
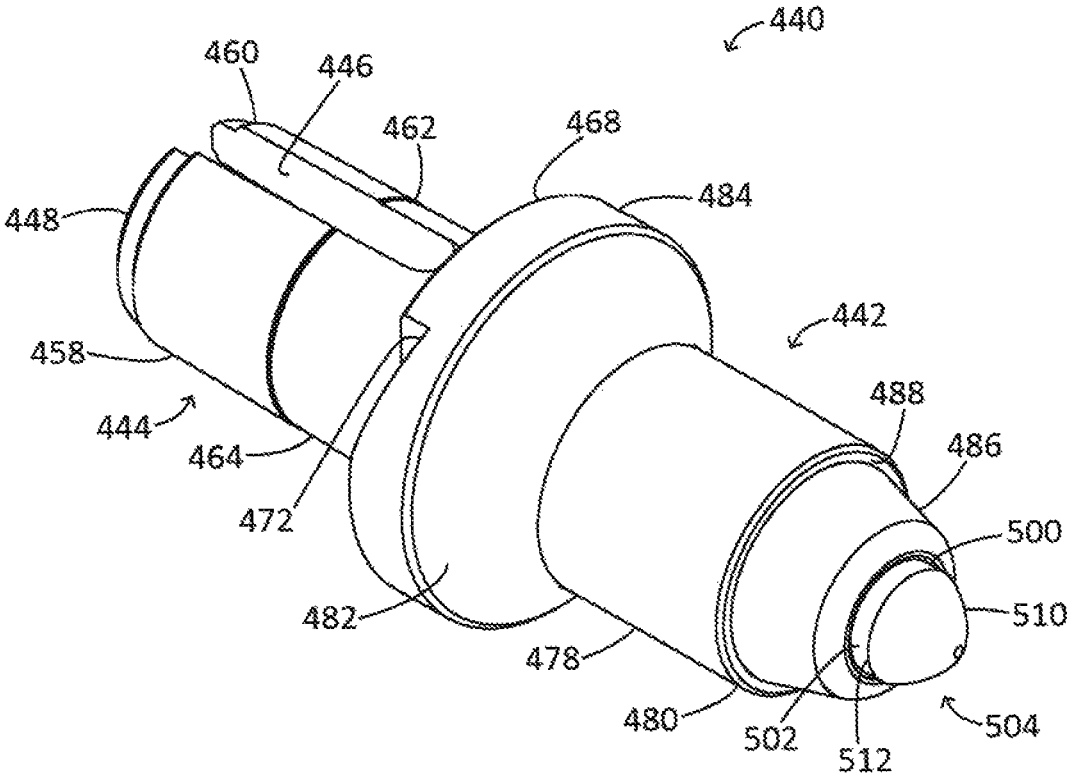
FIG. 20 is a side perspective view of the sixth embodiment of the bit/holder and the eighth embodiment of the tip insert in accordance with implementations of this disclosure.
Figure 21:
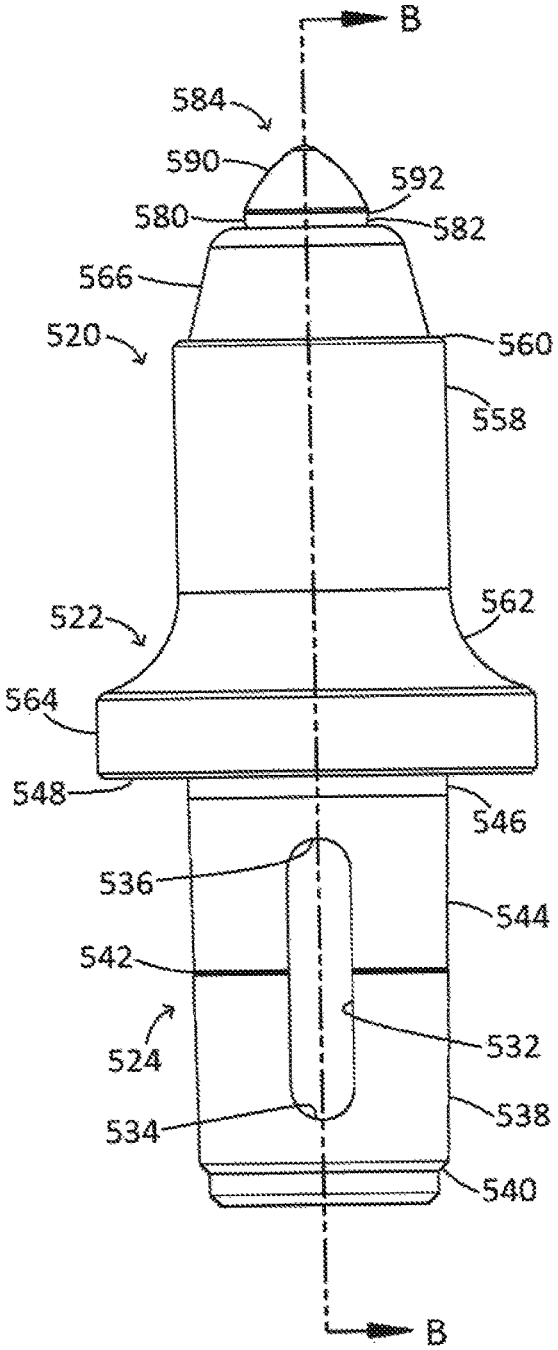
FIG. 21 is a side elevation view of a seventh embodiment of a bit/holder and a ninth embodiment of a tip insert in accordance with implementations of this disclosure.
Figure 22:
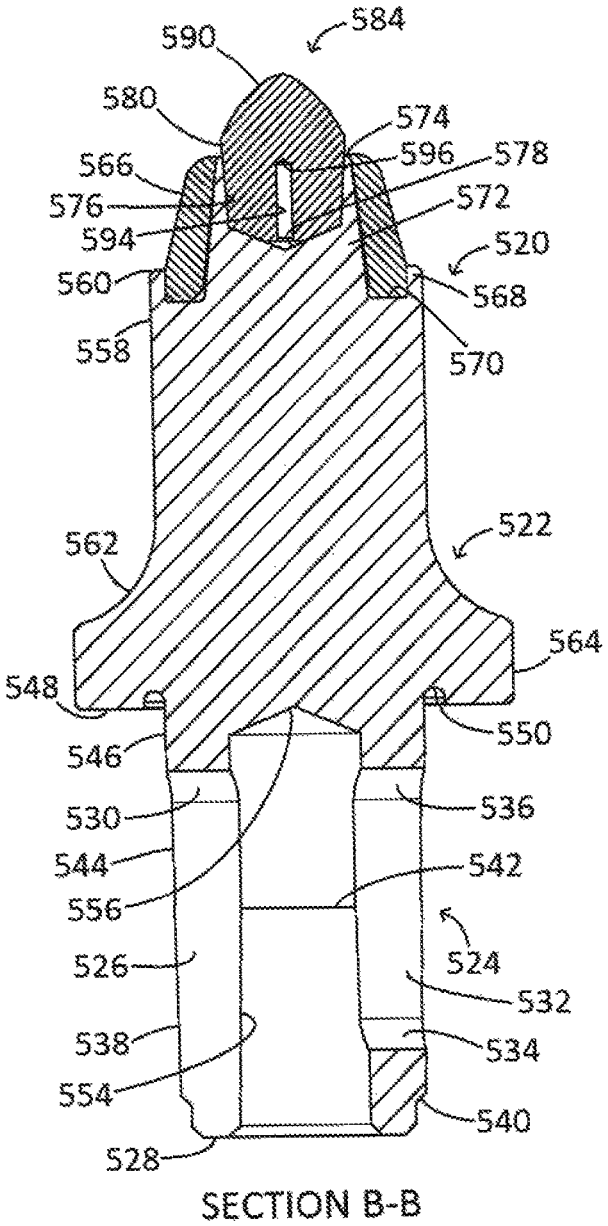
FIG. 22 is a cross-sectional view taken along line B-B of FIG. 21 of the seventh embodiment of the bit/holder and the ninth embodiment of the tip insert in accordance with implementations of this disclosure.

The bore 496 provides a space for receiving a complementary shaped generally cylindrical outer surface 502 of the base 500 of the tip insert 504 for the bit/holder combination. In one exemplary implementation of the eighth embodiment, the tip insert 504 can have a diameter in the range of ⅝ inch to 1¼ inch. In this eighth embodiment, the base 500 includes a tapered portion 506 adjacent a distal end 508 of the base 500, as shown in FIG. 19. The base 500 includes a tip 510 at an outer or forward end 512 of the base 500, both the base 500 and the tip 510 may be made of steel or tungsten carbide. In this illustrated embodiment, the tip insert 504, comprising the base 500 and the tip 510, goes through a sinter-HIP process that comprises a vacuum sinter with a post hot isostatic pressure (HIP) operation where the carbide of the tip insert 504 is first heated in a vacuum furnace at vacuum. At the end of the first vacuum sinter process, the vacuum is replaced by pressurized argon gas of many atmospheres, such as 10,000-40,000 PSI, which creates a sealed envelope of molten binder metals, such as cobalt around the carbide.

The tip insert 504 may, optionally in addition to the sinter-HIP process, go through a high pressure, high temperature (HPHT) process. In such a case where the HPHT process is also used, the sinter-HIP tip insert 504, which includes the tip 510 and the base 500, is centered and placed in a can or metal enclosure and a plurality of hydraulic pistons apply pressure and force on the can over time during the HPHT process, compressing and/or pressing the tip 510 and base 500 again. The HPHT process liquefies the binder material, such as cobalt in this embodiment, which binds to the tungsten carbide producing a stronger form. This optional secondary HPHT process improves the microstructure of the tip insert 504, providing much finer grain structure and improving the performance of the tip insert 504 in trenching, mining, and milling operations.

The tip insert 504 further includes a bore 514 (FIG. 18) that axially extends from the distal end 508 of the tip insert 504 to a bore termination 516 (FIG. 18), which in this illustrated embodiment, has a conical shape and is located within the base 500. In other embodiments, the bore termination 516 may have various other shapes, such as a rounded shape and a frustoconical shape, and may be located within the tip insert 504, adjacent the tip 510, and/or within the tip 510 adjacent an apex thereof. Additionally, in other embodiments, the tip insert 504 may further comprise at least one bore adjacent bore 514, each bore extending from the tapered portion 506 of the tip insert 504 to a bore termination that may have various shapes, such as a rounded shape, a conical shape, and a frustoconical shape, and may be located within the tip insert 504, within the base 500, adjacent the tip 510, and/or within the tip 510 adjacent an apex thereof. The bore 514, in this embodiment, and adjacent bores if optionally included, are formed by a wire-cut electrical discharge machining (EDM) process that removes material from the tip insert 504 by a series of rapidly recurrent discharges between two electrodes separated by a dielectric liquid and subject to an electric voltage. In an exemplary implementation of the eighth embodiment, the bore 514 can have a diameter of 3/32 inch. The bore 514 is adapted to allow for inward contraction and/or movement when the tip 510 distributes heat generated at the cutting tip 510 and transfers the heat into the base 500 during cutting operations. The bore 514 prevents less outward expansion of the tungsten carbide of the tip insert 504 in the direction of the tip 510 and thereby prevents the expanded tungsten carbide from fracturing the tip 510 of the tip insert 504.

Referring to FIGS. 21-24, an ninth embodiment of a generally conical tip insert 584, that includes a parabolic curved section below an apex of the tip insert 584, in a seventh embodiment of a bit/holder 520 of the present disclosure is shown. The bit/holder 520 is a unitary bit and bit holder construction that includes a body 522 and a generally cylindrical hollow shank 524 axially depending from a bottom of the body 522. The shank 524 includes an elongate first slot 526 (FIGS. 22 and 24) extending from a generally annular distal end 528 of the shank 524 axially upward or forward to an upper termination 530 (FIG. 22) adjacent the upper or forward end of the shank 524. In this embodiment, the shank 524 also includes an internally oriented second slot 532 located approximately 180 degrees around the annular shank 524 from the first slot 526. This second slot 532 is parallel to the first slot 526 and is an internal slot having a rearward semicircular termination 534 inwardly adjacent to the distal end 528 of the shank 524 and a forward semicircular termination 536 generally coinciding longitudinally and axially with the upper termination 530 of the first slot 526.

In this illustrated embodiment, the shank 524 includes a lower or first tapered portion 538 running axially from a stepped shoulder 540 adjacent the distal end 528 of the shank 524. The stepped shoulder 540 is disposed between the lower tapered portion 538 and the distal end 528. A diameter of the stepped shoulder 540 increases, or steps up, as it axially extends from adjacent the distal end 528 to the lower tapered portion 538. The first tapered portion 538 runs upwardly or axially from the stepped shoulder 540 of the shank 524 and terminates generally mid slot 526 longitudinally. The shank 524 also includes an annular shoulder 542 separating the lower tapered portion 538 from an upper or second tapered portion 544 which extends from the shoulder 542 to generally adjacent to the top of the shank 524 or forward terminations 530, 536 of slots 526, 532, respectively. The annular shoulder 542 is disposed between the lower tapered portion 538 and the upper tapered portion 544. A diameter of the annular shoulder 542 decreases, or steps down, as it axially extends from the lower tapered portion 538 to the upper tapered portion 544. A generally cylindrical top portion 546 of the shank 524 extends from a position adjacent the top or upper terminations 530, 536 of slots 526, 532, respectively, towards a generally annular back flange 548 that denotes the base or bottom of the body 522 of the bit/holder 520. The top of the shank 524 may include a rounded junction 550 (FIG. 22) between the top portion 546 of the shank 524 and the generally annular flange 548 of the body 522 of the bit/holder 520, which is provided to avoid sharp corners which may provide an area for stress cracks to begin.

The generally annular flange 548 includes a pair of horizontal slots 552-552 (FIG. 24) generally perpendicular to the longitudinal axis of the combination bit/bit holder, one on either side of the generally annular flange 548. The horizontal slots 552-552 are configured to receive a pair of bifurcated fork tines that may be inserted between the base of the body 522 of the bit/holder 520 and a base block (not shown) into which the shank 524 of the bit/holder combination is inserted and retained by outward radial force in use.

A central bore 554 (FIG. 22) longitudinally and axially extending through the shank 524 of the bit/holder 520 combination terminates at bore termination 556 (FIG. 22), which in this illustrated embodiment has a conical shape, that is approximately at the upper end of the shank 524. This allows the generally C-shaped annular side wall of the shank 524 to radially contract when the shank 524 is mounted in a tapered or cylindrical bore in a base block (not shown).

In this seventh illustrated embodiment of the bit/holder 520, the bit holder body 522 includes a generally cylindrical or annular upper body portion 558 depending from a forward end 560 of the upper body portion 558. A mediate body portion 562 subjacent the upper body portion 558 generally slopes axially and radially outwardly to a radially extending generally cylindrical tire portion 564. In this illustrated embodiment, the upper body portion 558 does not include a cross or through hole. Optionally, in alternate embodiments, a mid-section of the upper body portion of the bit/holder may include a cross or through hole substantially perpendicular to the longitudinal axis of the bit/holder. This cross or through hole extends horizontally through the upper body portion and forms a receiver for a drift pin (not shown) used in connection with the cup portion of a bit/holder insertion tool.

The bit holder body 522, in order to provide superior brazing of a tungsten carbide ring 566 to the forward end 560 of the upper body portion 558, includes a forwardly extending annular collar 568 (FIGS. 22 and 24) that is created on the bit holder body 522 to provide an annular trough 570 (FIG. 22) around a tapered forward extension 572 (FIGS. 22 and 23) of the bit holder body 522 onto which the annular ring 566 is mounted. The vertical outer wall of the collar 568 will keep brazing material from flowing outwardly of the joinder between the base of the ring 566 and the annular trough 570 on which the ring is positioned. The annular trough 570 is therearound positioned perpendicular to the axis of the bit/holder 520 from the interior of which axially extends the smaller radially oriented annular tapered upper or forward extension 572. Around this tapered forward extension 572 is fitted the annular tungsten carbide ring 566, seated in the annular trough 570, which may be brazed into unitary construction with the remainder of the bit/holder 520. The top or forwardmost portion of the tungsten carbide ring 566 and the annular tapered forward extension 572 of the upper body portion terminate generally at a forward end 574 (FIGS. 22 and 23) of the bit holder body 522 of the combination bit/holder 520.

With the bit holder body 522 of the present disclosure in this embodiment made of 4340 or equivalent steel, the top of the forward extension 572 of the bit holder body 522 includes a radially declining tapered bore 576 (FIG. 22), or a generally cylindrical bore in other embodiments, extending from the co-terminal upper wall of the body axially inwardly thereof which defines, in this illustrated embodiment, a radially declining taper. In other embodiments, the bore can also have a hollow generally cylindrical shape or a slight draw or draft angle. The bore 576 extends a short distance longitudinally axially inwardly of the forward extension 572 to define a base 578 (FIG. 22) for a base 580 of the tip insert 584. The base 578, in this illustrated embodiment, has a conical shape.

Figure 23:
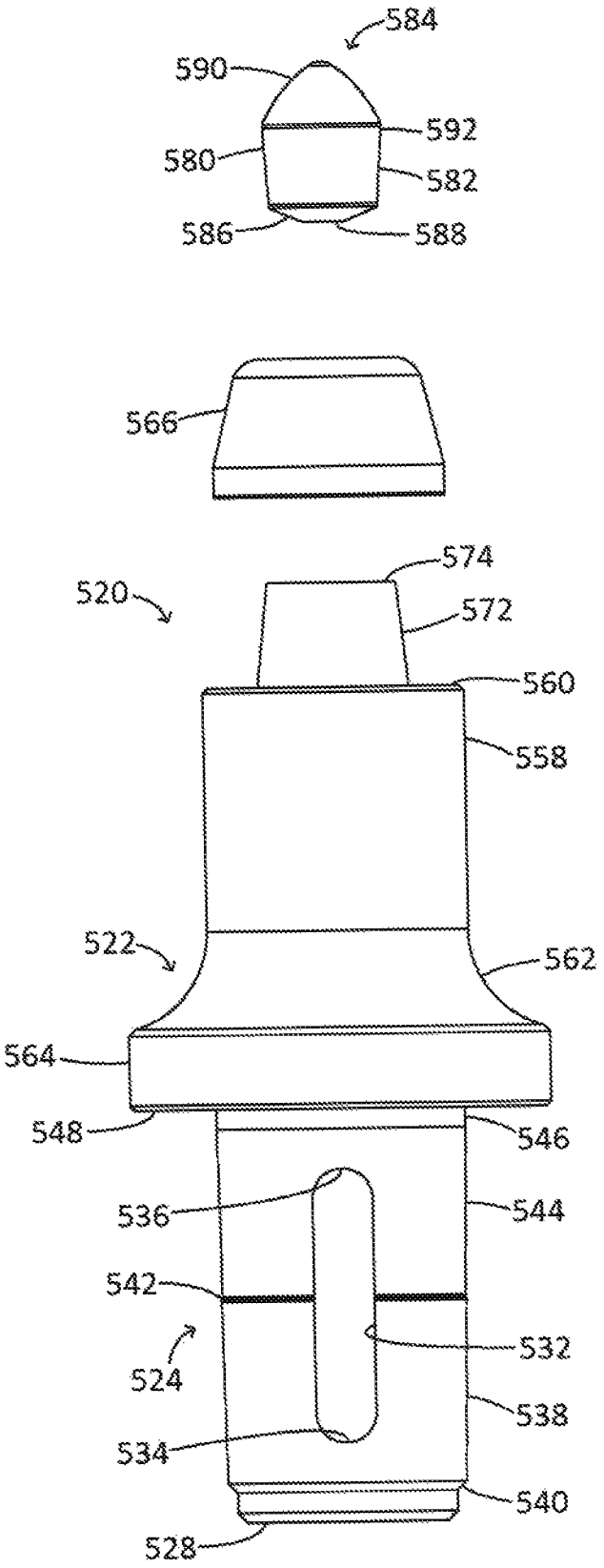
FIG. 23 is an exploded side elevation view of the seventh embodiment of the bit/holder and the ninth embodiment of the tip insert in accordance with implementations of this disclosure.
Figure 24:
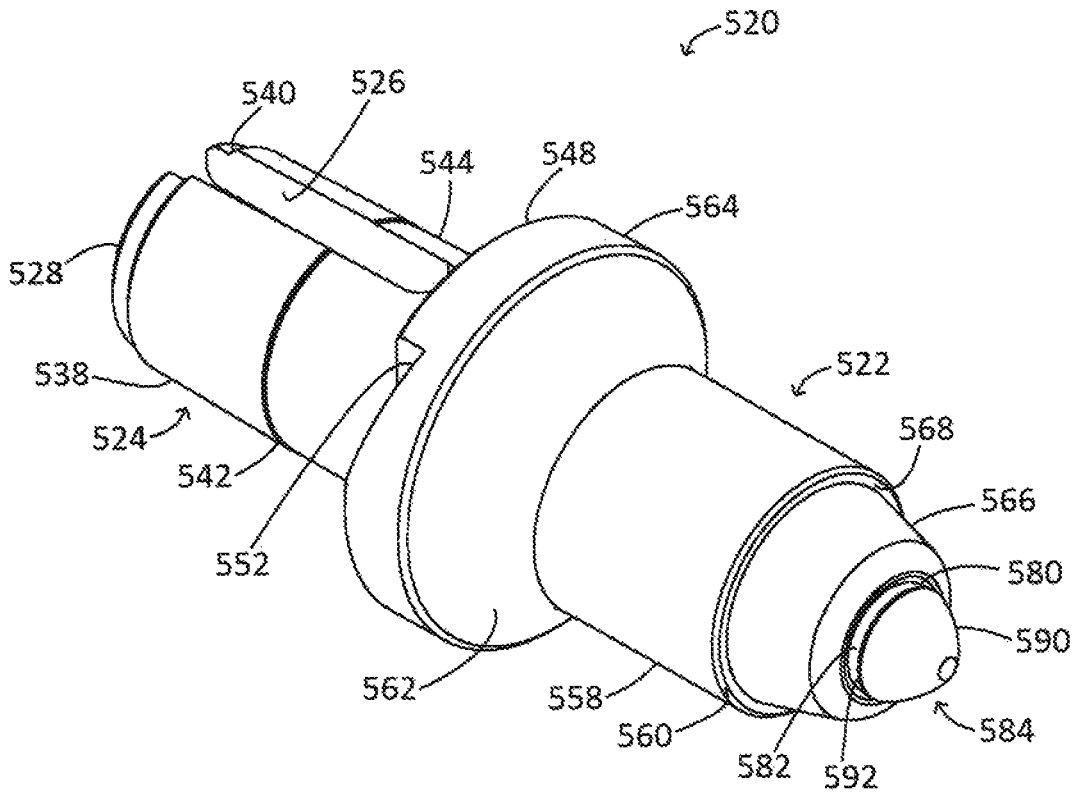
FIG. 24 is a side perspective view of the seventh embodiment of the bit/holder and the ninth embodiment of the tip insert in accordance with implementations of this disclosure.

The tapered bore 576 provides a space for receiving a complementary shaped declining tapered outer surface 582 of the base 580 of the tip insert 584 for the bit/holder combination. In one exemplary implementation of the ninth embodiment, the tip insert 584 can have a diameter in the range of ⅝ inch to 1¼ inch. In this ninth embodiment, the base 580 includes a tapered portion 586 adjacent a distal end 588 of the base 580, as shown in FIG. 23. The base 580 includes a tip 590 at an outer or forward end 592 of the base 580, both the base 580 and the tip 590 may be made of steel or tungsten carbide. In this illustrated embodiment, the tip insert 584, comprising the base 580 and the tip 590, goes through a sinter-HIP process that comprises a vacuum sinter with a post hot isostatic pressure (HIP) operation where the carbide of the tip insert 584 is first heated in a vacuum furnace at vacuum. At the end of the first vacuum sinter process, the vacuum is replaced by pressurized argon gas of many atmospheres, such as 10,000-40,000 PSI, which creates a sealed envelope of molten binder metals, such as cobalt around the carbide.

The tip insert 584 may, optionally in addition to the sinter-HIP process, go through a high pressure, high temperature (HPHT) process. In such a case where the HPHT process is also used, the sinter-HIP tip insert 584, which includes the tip 590 and the base 580, is centered and placed in a can or metal enclosure and a plurality of hydraulic pistons apply pressure and force on the can over time during the HPHT process, compressing and/or pressing the tip 590 and base 580 again. The HPHT process liquefies the binder material, such as cobalt in this embodiment, which binds to the tungsten carbide producing a stronger form. This optional secondary HPHT process improves the microstructure of the tip insert 584, providing much finer grain structure and improving the performance of the tip insert 584 in trenching, mining, and milling operations.

The tip insert 584 further includes at least one bore 594 (FIG. 22) that axially extends from the distal end 588 of the tip insert 584 to a bore termination 596 (FIG. 22), which in this illustrated embodiment has a conical shape and is located within the base 580. In other embodiments, the bore termination 596 may have various other shapes, such as a rounded shape and a frustoconical shape, and may be located within the tip insert 584, adjacent the tip 590, and/or within the tip 590 adjacent an apex thereof. Additionally, in other embodiments, the tip insert 584 may further comprise at least one bore adjacent bore 594, each bore extending from the tapered portion 586 of the tip insert 584 to a bore termination that may have various shapes, such as a rounded shape, a conical shape, and a frustoconical shape, and may be located within the tip insert 584, within the base 580, adjacent the tip 590, and/or within the tip 590 adjacent an apex thereof. The bore 594, in this embodiment, and adjacent bores if optionally included, are formed by a wire-cut electrical discharge machining (EDM) process that removes material from the tip insert 584 by a series of rapidly recurrent discharges between two electrodes separated by a dielectric liquid and subject to an electric voltage. In an exemplary implementation of the ninth embodiment, the bore 594 can have a diameter of 3/32 inch. The bore 594 is adapted to allow for inward contraction and/or movement when the tip 590 distributes heat generated at the cutting tip 590 and transfers the heat into the base 580 during cutting operations. The bore 594 prevents less outward expansion of the tungsten carbide of the tip insert 584 in the direction of the tip 590 and thereby prevents the expanded tungsten carbide from fracturing the tip 590 of the tip insert 584.

As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, "X includes at least one of A and B" is intended to mean any of the natural inclusive permutations. That is, if X includes A; X includes B; or X includes both A and B, then "X includes at least one of A and B" is satisfied under any of the foregoing instances. The articles "a" and "an" as used in this application and the appended claims should generally be construed to mean "one or more" unless specified otherwise or clear from context to be directed to a singular form. Moreover, use of the term "an implementation" or "one implementation" throughout is not intended to mean the same embodiment, aspect or implementation unless described as such.

While the present disclosure has been described in connection with certain embodiments and measurements, it is to be understood that the present disclosure is not to be limited to the disclosed embodiments and measurements but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A sinter-hot isostatic pressing (sinter-HIP) bit tip insert for road milling comprising:

a body comprising a tip and a base subjacent the tip, the tip comprising a parabolic curved section below an apex of the tip, the base comprising a sidewall and a frustoconical distal end, the sidewall extending from the tip to the frustoconical distal end;

a widest diameter of said bit tip insert being adjacent where said tip joins said sidewall of said base;

a first bore axially extending from a flat portion of the frustoconical distal end to a conical first bore termination disposed within one of the base and the tip, the first bore adapted to allow inward contraction when heat is transferred from the tip to the base during operation; and the bit tip insert where said tip meets said sidewall comprising a diameter in the range of and including ⅝ inch and 1¼ inch.

2. The bit tip insert of claim 1, wherein at least one of the tip and the base comprises one of steel and tungsten carbide.

3. The bit tip insert of claim 1, further comprising:

at least one second bore radially positioned from the first bore, the at least one second bore extending from a tapered portion of the frustoconical distal end, each second bore including a second bore termination disposed within one of the base and the tip, and each second bore adapted to allow inward contraction when the tip transfers heat into the base during operation.

4. The bit tip insert of claim 1, wherein the tip comprises one of a conical shape including the parabolic curved section below the apex thereof and a parabolic shape including the parabolic curved section below the apex thereof.

5. The bit tip insert of claim 1, wherein the sidewall of the base is one of cylindrical and tapered inwardly toward a bottom of the base.

6. The bit tip insert of claim 1, wherein a distance between the conical first bore termination and the apex of the tip is at least one of at least approximately 3/16 inch and at least approximately ¼ inch.

7. The bit tip insert of claim 1, further comprising:

an insert disposed within the first bore of the bit tip insert, the insert adapted to transfer heat from the bit tip insert.

8. The bit tip insert of claim 7, wherein the insert disposed within the first bore comprises at least one of a solid heat transfer material, a hollow heat transfer material, a tubular heat transfer material, and a hollow cylindrical heat transfer material.

9. The bit tip insert of claim 7, wherein the insert disposed within the first bore comprises copper.

10. The bit tip insert of claim 1, further comprising:

a plurality of diamond particles disposed within the first bore of the bit tip insert, the diamond particles adapted to distribute heat generated at the tip.

11. The bit tip insert of claim 10, wherein the plurality of diamond particles are at least one of brazed in the first bore, packed within the first bore, and bonded with epoxy in the first bore.

12. The bit tip insert of claim 10, further comprising:

a metal plug disposed within the first bore between the plurality of diamond particles and the frustoconical distal end of the body.

13. A tool for road milling comprising:

a body comprising a first bore extending inwardly from a forward end of the body;

a shank extending centrally axially from a bottom of the body; and a sinter-hot isostatic pressing (sinter-HIP) bit tip insert disposed in the first bore, the bit tip insert comprising:

a bit tip insert body comprising a tip and a base subjacent the tip, the tip comprising a parabolic curved section below an apex of the tip, the base comprising a sidewall and a frustoconical distal end, the sidewall extending from the tip to the frustoconical distal end;

a widest diameter of said bit tip insert being adjacent where a bottom of said tip meets a top of said sidewall;

a second bore axially extending from a flat portion of the frustoconical distal end of the bit tip insert body to a conical second bore termination disposed within one of the base and the tip, the second bore adapted to allow inward contraction when heat is transferred from the tip to the base during operation; and the bit tip insert where a bottom of said tip meets a top of said sidewall comprising a diameter in the range of and including ⅝ inch and 1¼ inch.

14. The bit holder of claim 13, wherein the first bore is one of cylindrical and tapered inwardly.

15. The tool of claim 13, a tapered portion adjacent the frustoconical distal end of the bit tip insert body of the bit tip insert, the tapered portion adapted to contact a portion of the first bore of the body.

16. The tool of claim 15, further comprising:

at least one third bore radially positioned from the second bore, the at least one third bore extending from the tapered portion adjacent the frustoconical distal end, each third bore including a third bore termination disposed within one of the base and the tip, and each third bore adapted to allow inward contraction when heat is transferred from the tip to the base during operation.

17. The tool of claim 13, further comprising:

a forward extension adjacent the forward end of the body, the forward extension comprising one of a tapered sidewall and a cylindrical sidewall, and the first bore axially extending from the forward end to a first bore termination disposed within the forward extension.

18. The tool of claim 17, further comprising:

an annular trough laterally extending from a distal end of the forward extension;

an annular ring disposed around the forward extension and seated in the annular trough of the body; and said annular ring being tapered toward said distal end of the forward extension.

19. The tool of claim 18, wherein the annular ring comprises tungsten carbide.

20. The tool of claim 13, wherein at least one of the tip and the base comprises one of steel and tungsten carbide.

21. The tool of claim 13, wherein the sidewall of the base is one of cylindrical and tapered inwardly toward a bottom of the base.

22. The tool of claim 13, wherein a distance between the conical second bore termination and the apex of the tip is at least one of at least approximately 3/16 inch and at least approximately ¼ inch.

23. The tool of claim 13, further comprising:

an insert having a first end and a second end, the first end of the insert disposed within the second bore of the bit tip insert, the insert adapted to transfer heat from the bit tip insert.

24. The tool of claim 23, wherein the insert disposed within the second bore of the bit tip insert is made of a heat transfer material.

25. The tool of claim 23, wherein the insert disposed within the second bore of the bit tip insert is made of copper.

26. The tool of claim 13, further comprising:

a plurality of diamond particles disposed within the second bore of the bit tip insert, the diamond particles adapted to distribute heat generated at the tip.

27. The tool of claim 26, wherein the plurality of diamond particles are at least one of brazed in the second bore, packed within the second bore, and bonded with epoxy in the second bore.

28. The tool of claim 26, further comprising:

a metal plug disposed within the second bore between the plurality of diamond particles and the distal end of the bit tip insert body.

* * * * *